US006758022B1

(12) United States Patent
Coll et al.

(10) Patent No.: US 6,758,022 B1
(45) Date of Patent: Jul. 6, 2004

(54) STRUCTURAL FRAMEWORK AND WEBS THEREFOR

(75) Inventors: Stephen Anthony Coll, Christchurch (NZ); John Tadich, Knoxfield (AU)

(73) Assignee: MiTek Holdings, Inc., Chesterfield, MO (US)

( * ) Notice: Subject to any disclaimer, the term of this patent is extended or adjusted under 35 U.S.C. 154(b) by 108 days.

(21) Appl. No.: 10/069,277

(22) PCT Filed: Aug. 24, 2000

(86) PCT No.: PCT/US00/23367

§ 371 (c)(1),
(2), (4) Date: Jun. 17, 2002

(87) PCT Pub. No.: WO01/14658

PCT Pub. Date: Mar. 1, 2001

(30) Foreign Application Priority Data

| | | |
|---|---|---|
| Aug. 25, 1999 | (NZ) | 337427 |
| Jan. 28, 2000 | (NZ) | 502650 |
| May 9, 2000 | (NZ) | 504428 |

(51) Int. Cl.[7] ..... E04C 3/02; E04C 3/30; E04H 12/00

(52) U.S. Cl. ..... 52/690; 52/693; 52/696; 52/639; 52/638

(58) Field of Search ..... 52/690, 693, 696, 52/639, 650.2, 653.2, 638, 697

(56) References Cited

U.S. PATENT DOCUMENTS

| | | | | | |
|---|---|---|---|---|---|
| 774,159 | A | * | 11/1904 | Cook | 52/697 |
| 1,609,784 | A | * | 12/1926 | Springob | 52/693 |
| 1,865,059 | A | | 6/1932 | Ragsdale | |
| 1,924,881 | A | | 8/1933 | Ragsdale | |
| 2,146,539 | A | * | 2/1939 | Burke et al. | 52/693 |
| 2,803,045 | A | * | 8/1957 | Horner | 52/695 |
| 2,846,760 | A | | 8/1958 | Rohn | |
| 3,288,977 | A | | 11/1966 | Keller | |
| 3,353,320 | A | * | 11/1967 | Grasis | 52/693 |
| 3,416,283 | A | * | 12/1968 | Arthur | 52/693 |
| 3,447,278 | A | | 6/1969 | Collins | |
| 3,800,490 | A | * | 4/1974 | Conte | 52/250 |
| 3,842,560 | A | | 10/1974 | Campbell | |
| 3,882,653 | A | | 5/1975 | Ollman | |
| 3,925,951 | A | | 12/1975 | Jackson et al. | |
| 4,030,264 | A | | 6/1977 | Jackson | |
| 4,348,850 | A | | 9/1982 | Reeder et al. | |
| 4,435,940 | A | | 3/1984 | Davenport et al. | |
| 4,475,328 | A | | 10/1984 | Reeder et al. | |
| 4,501,102 | A | * | 2/1985 | Knowles | 52/690 |
| 4,570,407 | A | * | 2/1986 | Palacio et al. | 52/693 |
| 4,621,475 | A | * | 11/1986 | McClain | 52/693 |
| 4,637,195 | A | | 1/1987 | Davis | |
| 4,682,460 | A | | 7/1987 | Reetz | |
| 5,003,748 | A | | 4/1991 | Carr | |
| 5,622,022 | A | * | 4/1997 | Haisch | 52/713 |
| 5,974,759 | A | * | 11/1999 | Burger | 52/695 |
| 5,983,577 | A | * | 11/1999 | Hays | 52/79.1 |
| 6,393,794 | B1 | * | 5/2002 | Pellock | 52/696 |
| 6,412,246 | B1 | * | 7/2002 | Tadich | 52/633 |

FOREIGN PATENT DOCUMENTS

| | | |
|---|---|---|
| AU | 295018 | 10/1967 |
| GB | 2158122 A | 11/1985 |
| NZ | 210049 | 9/1988 |
| NZ | 314829 | 5/1998 |
| NZ | 305606 | 7/1999 |
| WO | WO 98/59128 | 12/1998 |
| WO | WO 00/37745 | 6/2000 |

* cited by examiner

*Primary Examiner*—Carl D. Friedman
*Assistant Examiner*—Nahid Amiri
(74) *Attorney, Agent, or Firm*—Senniger, Powers, Leavitt & Roedel

(57) ABSTRACT

A web member for use in reinforcing a structural framework, such as a truss or a wall panel, comprised of beams and web members secured to the beams. A web member includes a support section with a longitudinally extending tab on each end thereof. The tabs are bent to engage inside surfaces of the beams for securement thereto as with screw fasteners whereby the web member is secured to and extends between beams of the truss.

16 Claims, 41 Drawing Sheets

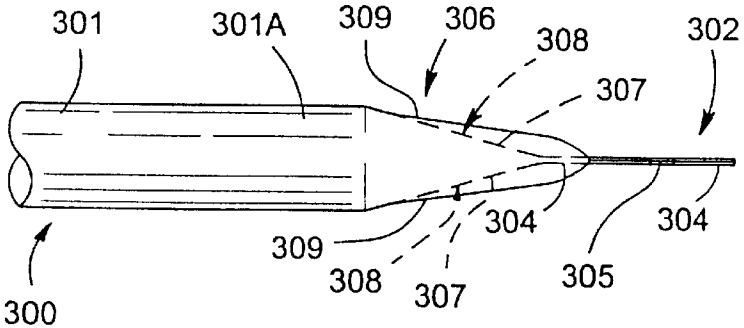
FIG. 23
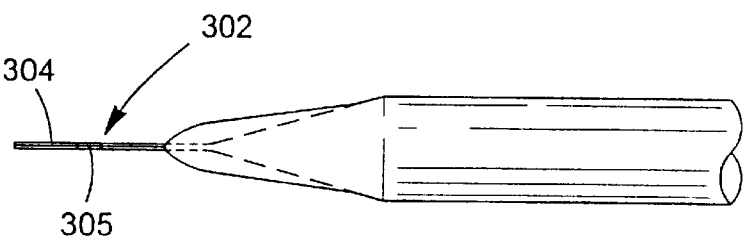
FIG. 24
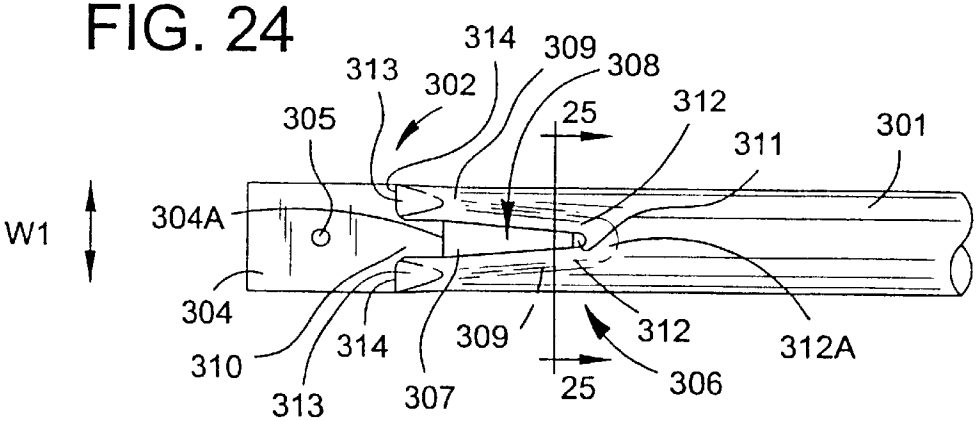

STRUCTURAL FRAMEWORK AND WEBS THEREFOR

BACKGROUND OF THE INVENTION

The present invention relates to a framework including reinforcing webs and to the reinforcing webs.

Structural frameworks of the type to which the present invention generally relate are typically found in buildings and commonly take the form of trusses or braced wall panels. Trusses come in several forms with two typical forms being a pitched truss (e.g., a roof truss) and a straight or parallel chords truss (e.g., a floor truss). Trusses are formed with chords having webs connected thereto to reinforce the truss. Braced wall panels are similarly constructed, but used in an orientation where the chords or "beams" extend generally vertically. Over the years, webs have evolved from lumber cut to shape and length and toe nailed into place. Later, such wooden webs were joined with nailing plates having integral nails. Currently, all metal webs with integral nailing plates pressed into the sides of the chords are used to construct some trusses (particularly flat trusses). The evolution of webs and their securement has improved both the efficiency in manufacture and the structural integrity of the formed truss.

During the construction of trusses using wood webs and separate nailing plates or metal webs with integral nailing plates, the set up of the truss forming machine is time consuming and critical since it is necessary to set up the jig with reaction pads or pedestals for use in driving the nailing plates into the webs and/or chords. Further, when the truss uses wood webs and separate nailing plates, each web has to be custom cut (although the webs may be mass produced to a unique configuration) and positioned by hand to effect installation which is time consuming and therefore costly. Further, as the price of wood has increased, metal webs have become more economically attractive. The metal webs that are pressed into the sides of the chords, unlike wood webs that fit between inside edges of the cords, may sometimes make stacking of the trusses difficult because the webs have portions that project from the opposite faces of the chords. There is thus a need for an improved metal web that fits between inside edges of the chords like wood webs.

SUMMARY OF THE INVENTION

Among the several objects and features of the present invention may be noted the provision of a metal web that will fit between the beams of a structural framework; the provision of such a web that can be easily secured to the beams; the provision of such a web having a single configuration useable on a variety of frameworks with the same configuration; the provision of such web that can be economically made and used; and the provision of a structural framework utilizing such a web.

A metal web member of the present invention is preferably for use in a fabricated framework comprising at least two spaced apart beams with transverse thickness and having exterior surfaces and at least one web member secured to the beams and extending between generally opposed exterior surfaces of the beams. The web member comprises a support section having transverse width substantially equal to or less than the transverse thickness of the beams and having opposite ends. A tab extending longitudinally from the support section at each end thereof has planar engagement surfaces. Each tab is sized and shaped for generally flat, face-to-face engagement of its planar engagement surface with a respective one of the exterior surfaces of one of the beams for of the tab securement thereto. The tabs are further adapted to receive a fastener through the planar engagement surface for the securement of the web member to the beams.

In another aspect of the present invention, a method of constructing a structural framework for a building comprises the step of providing first and second beams at least partially spaced apart, each beam having longitudinally extending exterior surfaces. At least one metal web is provided for interconnection between the first and second beams. The web has a support section and a tab extending outwardly from generally adjacent each end of the support section. Each tab is formed to have a planar engagement surface and a fastener hole extending through the planar surface. The tabs at each end of the support section of the metal web are arranged for flat, face-to-face engagement with one of the exterior surfaces of a respective one of the first and second beams such that the support section extends at an angle with respect to the first and second beams. The tabs are secured to the beams by passing a fastener through the fastener hole of each tab and into said respective one of the first and second beams.

In yet another aspect of the present invention, a tool for driving a screw through a web and into a beam of a structural framework for a building comprises a tool head having an engaging portion for engaging a head of a screw to rotate the screw and drive the screw into the workpiece in a direction parallel to the longitudinal axis of the screw. A drive shaft is arranged transverse with respect to the intended direction of driving of the screw into the work piece. A drive transmission between the drive shaft and the engaging portion transmits rotary drive from the drive shaft to the engaging portion. The drive transmission is constructed to limit the torque applied by the tool head to the screw.

In still another aspect of the present invention, a die tool forms a securing tab on a metal web to be used in forming a structural framework for a building. The die tool includes a bottom die tool having a squash block and a capture block, the squash block being moveable relative to the capture block. A top die tool has a squash block moveable relative to a capture block. A guillotine block is movable relative to the squash blocks and the capture blocks to cut the web. The web is retained by the capture blocks and the squash blocks are moved relative to the capture blocks so as to squash the end of the web so as to form a flattened portion of the securing tab. The guillotine block is moved relative to both the capture blocks and the squash blocks so as to cut lateral edge portions from the flattened portion of the securing tab.

Other objects and features will be in part apparent and in part pointed out hereinafter.

BRIEF DESCRIPTION OF THE DRAWINGS

FIG. 23 is a side view of a metal web for a building truss, shown broken in the middle, according to an embodiment of the invention;

FIG. 24 is a plan view of a left end of the web of FIG. 23;

Corresponding reference characters indicate corresponding parts throughout the several views of the drawings.

DETAILED DESCRIPTION OF THE PREFERRED EMBODIMENT

Figure 1:
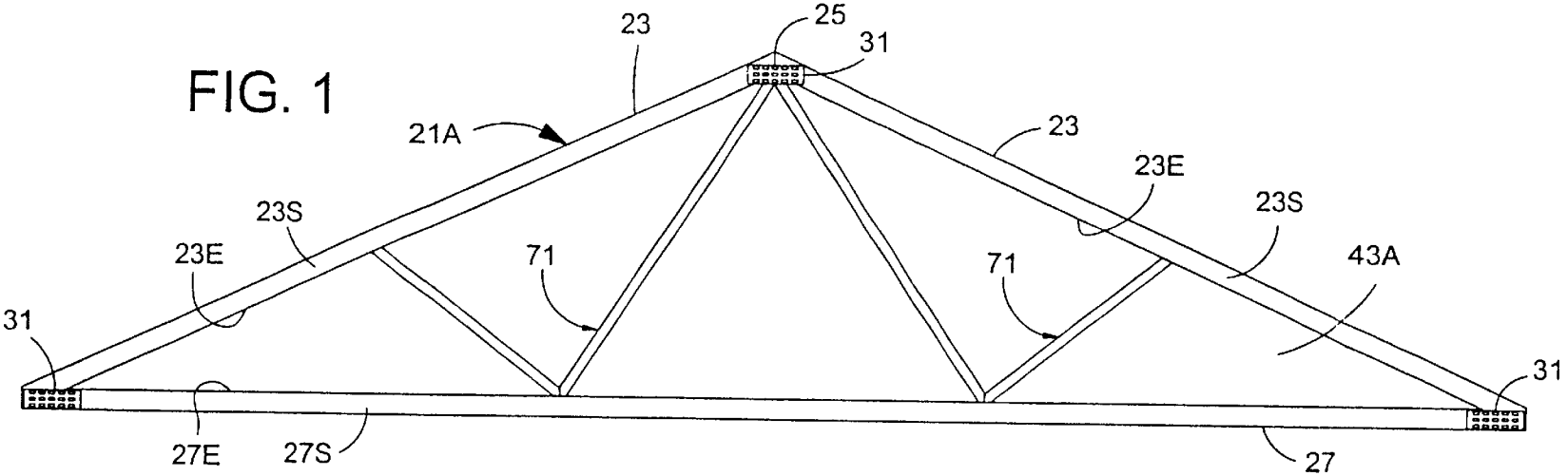
FIG. 1 shows a standard pitched roof truss with four webs extending between the chords with the web members being of the general type shown in FIG. 5.
Figure 2:
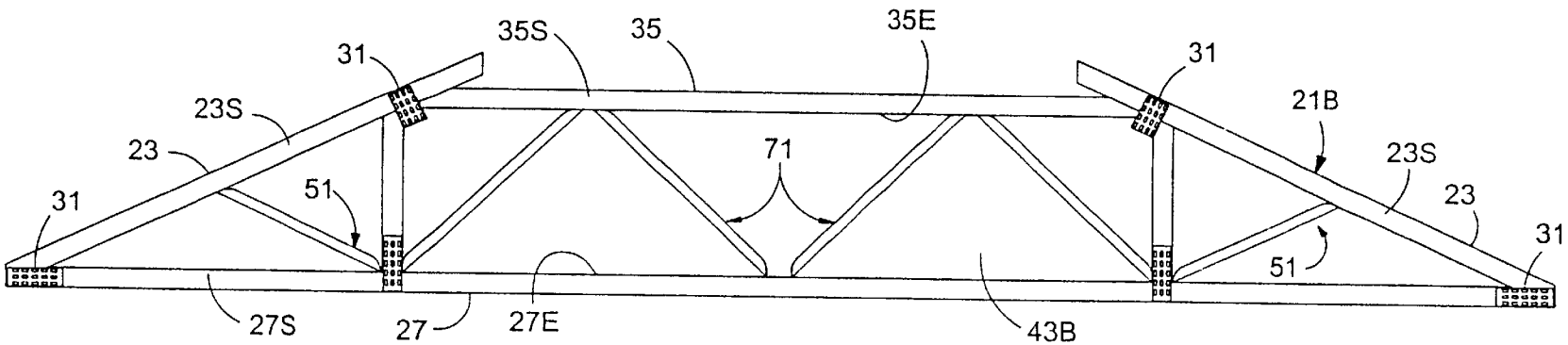
FIG. 2 shows a truncated pitched roof truss showing the use of a pair of web members of the type shown in FIG. 11C.
Figure 3:
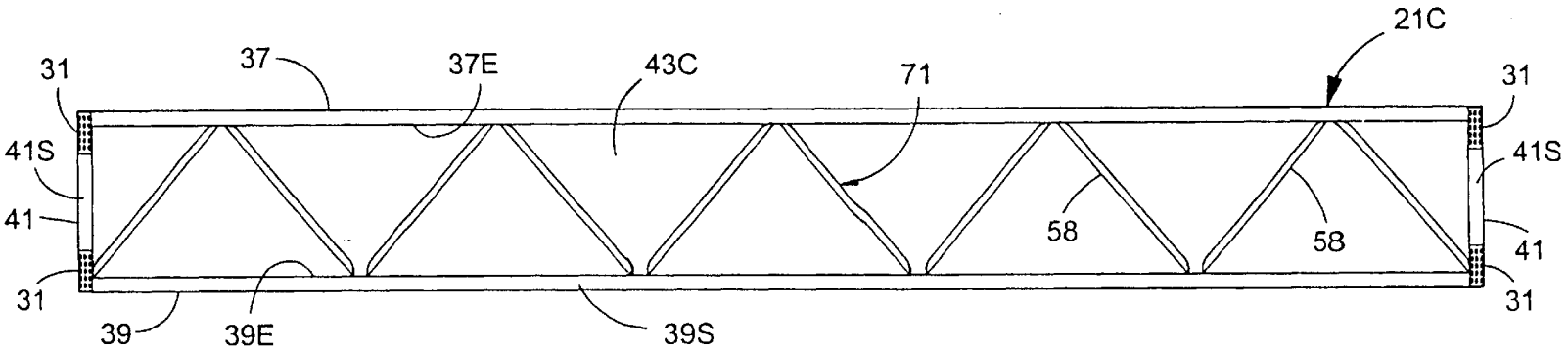
FIG. 3 shows a parallel chords truss illustrating the use of web members of the general type shown in FIG. 5.
Figure 6:
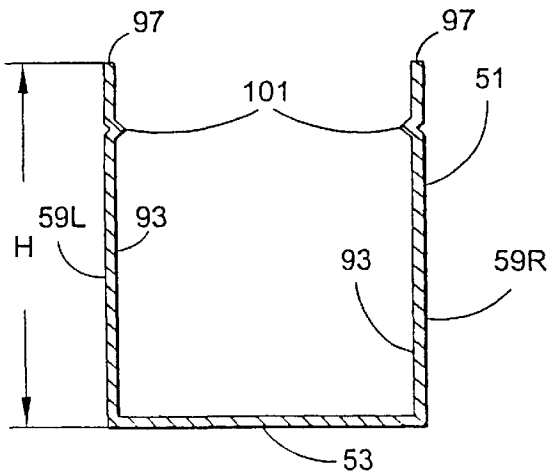
FIG. 6 is an enlarged cross section of a web member and insert taken along the line 6—6, FIG. 5.

The reference numerals 21A, 21B, 21C designate generally three different styles of truss, 21A being a pitched roof truss (FIG. 1), 21B being a truncated pitched roof truss (FIG. 2) and 21C being a parallel chords truss (usable, e.g., as a floor truss)(FIG. 3). Truss 21A comprises a pair of sloped top chords 23 joined at the apex 25 and a bottom chord 27 joined to the top chords 23 adjacent lower ends of the top chords with, nailing plates 31. The chords are broadly referred to herein as "beams". The truss 21A is generally triangularly shaped. The truss 21B is similar to the truss 21A except it has a truncated top formed by a horizontal top chord 35 extending between and secured to the chords 23 with, e.g., nailing plates 31. The truss 21C comprises top and bottom chords 37, 39 and can be provided with generally vertical end posts 41 secured to the chords 37, 39 also with nailing plates 31. The chords 23, 27, 35, 37, 39 have inside edges 23E, 27E, 35E, 37E, 39E at least partially defining interior spaces 43A, 43B, 43C for the trusses 21A–C respectively. The width of the inside edges is the transverse thickness thereof and of the trusses. The chords 23, 27, 35, 37, 39 and posts 41 also have opposite side faces 23S, 27S, 35S, 37S, 39S,41S respectively lying in generally parallel planes for each of the trusses. Preferably the chords are wood, for example so-called 2×4's (nominally 1½"×3½"). For the trusses 21A, 21B, the narrow surface (1½") is typically the inside edge, while for a parallel chords truss 21C, the wide surface (3½") is typically the inside edge. However, it is to be understood that the chords could be made of metal without departing from the scope of the present invention.

A formed metal web member is provided and is secured to and extends between at least two chords of a truss. Three forms of web members are shown, the form in FIGS. 10A–10E, the form in FIGS. 11A–11F and the forms in FIGS. 17 and 23. All forms have common features and will be first described in regard to the form shown in FIGS. 4 and 10A–10E, all being the same construction except for dimensions. A web member 51 includes an elongate bottom wall 53 having opposite ends and opposite side edges. Preferably, the wall 53 is generally planar. At least one side wall and as shown, a pair of side walls 59L, 59R extend upwardly from the wall 53 at the side edges and form a central support section 58. The walls 59 are generally parallel and preferably generally normal to the wall 53 and form an open sided channel with the wall 53. The walls 59 have opposite ends 61L, 61R that are preferably contoured as by rounding or in other suitable shapes. A fastening tab 63 extends from each of the opposite ends of the central support section. The tabs 63 have generally planar oppositely facing surfaces with one or more apertures 67 extending therethrough. The web member is preferably metal, e.g., steel, galvanized for rust resistance and has a suitable thickness such as about 0.85 mm. The width W of the tab 63 is approximately equal to or slightly less than the width of the inside edge of the chord to which the web member is to be secured. The length L of the tabs 63 is about 35 mm and their width is about 20 mm in the illustrated embodiment. The spacing between the walls 59 is approximately equal to the width W of the tabs. The height of the walls will be determined by the resistance to bending needed in web member and in one embodiment are in a range of about 50 mm to 70 mm. The web member 51 can be made from flat sheet material and cut to shape and then roll formed or bent on a brake to form the walls 59. When completed, the bottom wall 53 is generally planar as are the walls 59 . The walls 53, 59 are one piece with each other and form an open ended channel.

Figure 4:
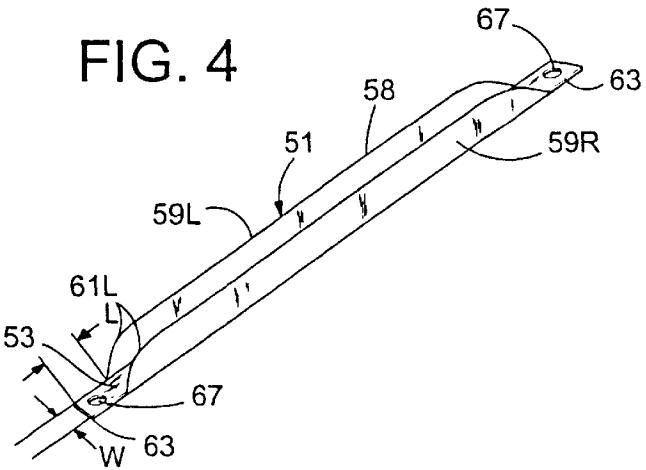
FIG. 4 is a perspective of a web member of the type shown in FIGS. 10A–10E.
Figure 4B:
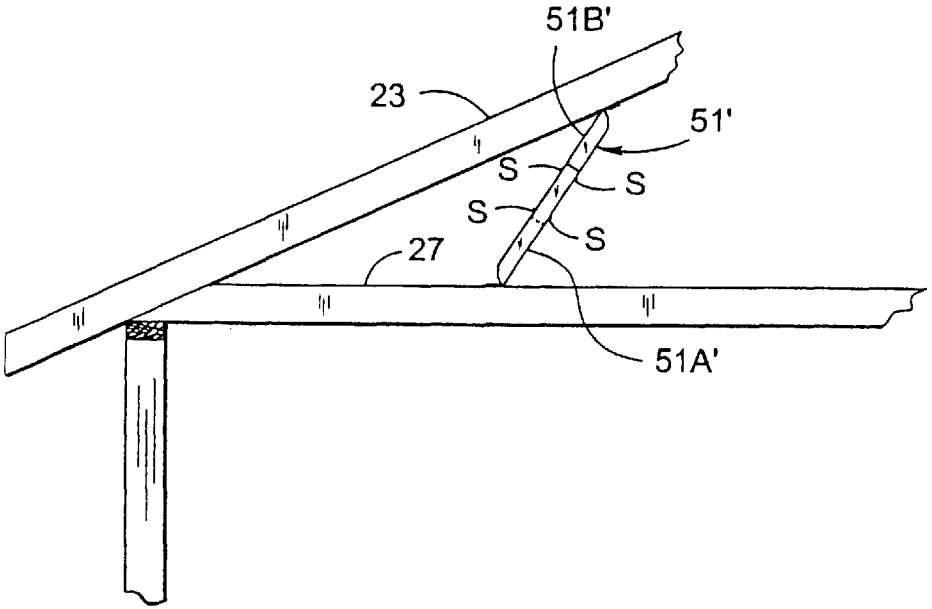
FIG. 4B is an elevation of a truss incorporating the adjustable length web member of FIG. 4A.
Figure 4A:
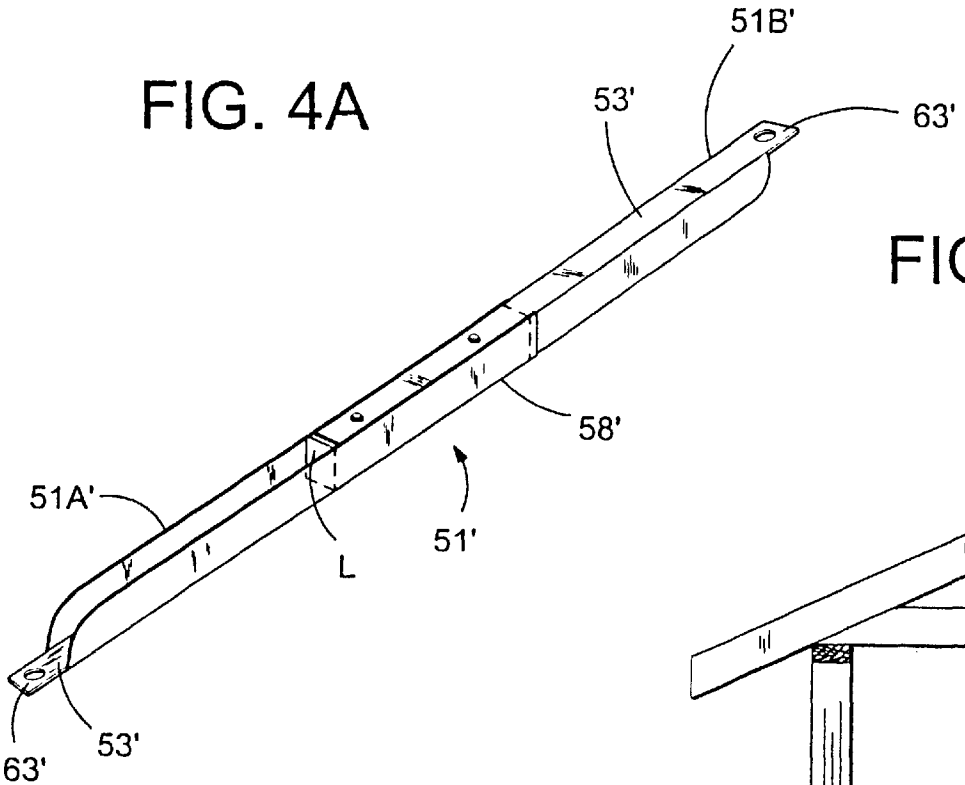
FIG. 4A is a perspective of an adjustable length web member similar to the fixed length web member of FIG. 4.
Figure 5:
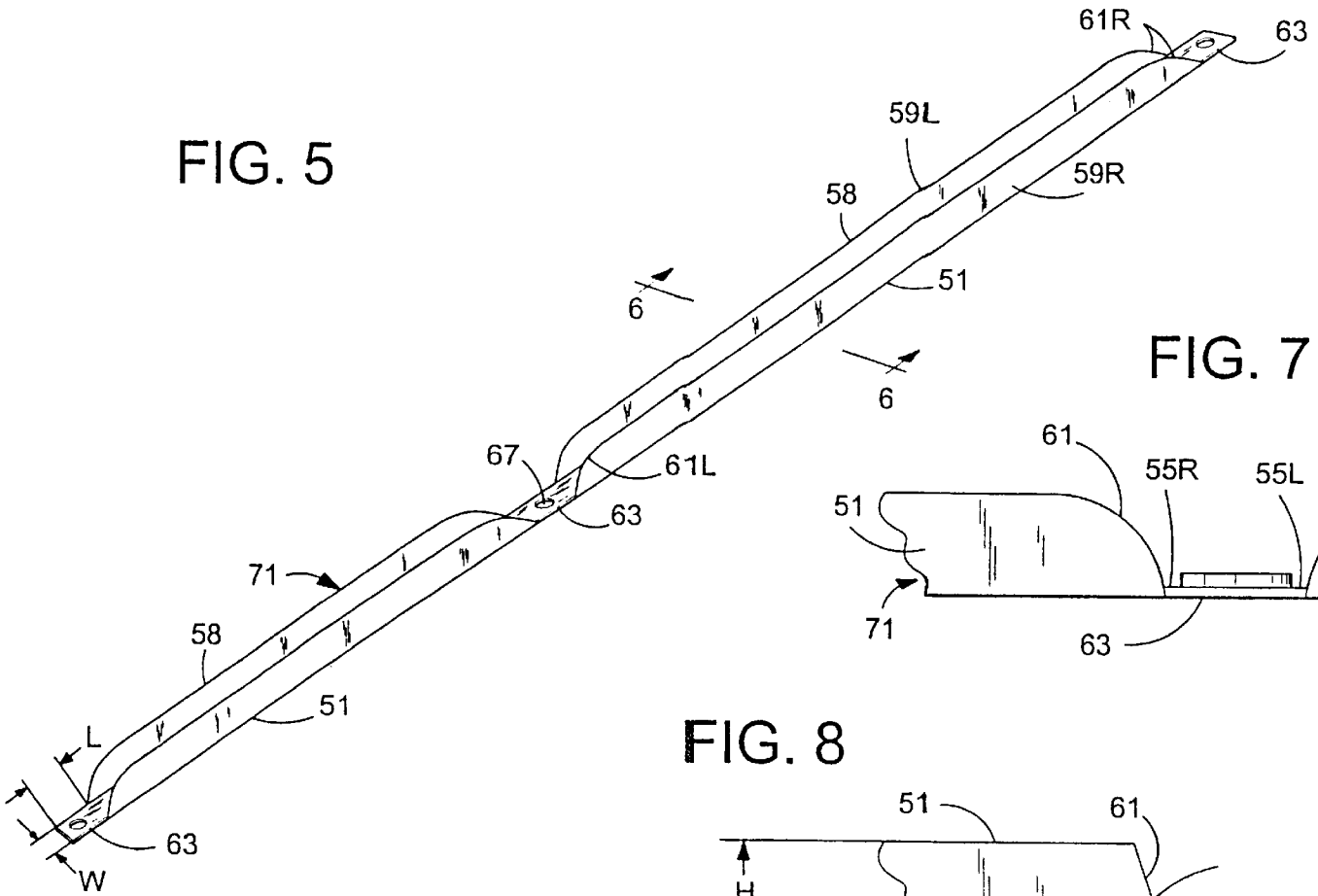
FIG. 5 is a perspective of a web member of the type shown in FIGS. 11A–11F that provides a plurality of interconnected web member sections.

An adjustable length web member 51' having a basic construction similar to the web member 51 of FIG. 4 is shown in FIGS. 4A and 4B. Corresponding parts of the web member 51' will be designated by the same reference numerals used for the web member 51 of FIG. 4, followed by a prime. The web member 51' includes two web elements 51A' and 51B', each having the channel shaped construction of FIG. 4, but including a tab 63' at only one end. The web member 51B' is inverted from the position of web member 51A' and inserted into the open end of the web member 51A' opposite the end having the tab 63'. The overall length of the web member 51' is determined by the lengths of the web elements 51A' and 51B', and how far element 51B' is inserted into 51A'. When the desired overall length is achieved, the web elements 51A' and 51B' are secured together by pairs of sheet metal screws S driven through the bottom wall 53' of the element 51A' and the bottom wall 53' of the element 51B'. Preferably a short piece of lumber L is placed in the overlapping section of the web elements 51A' and 51B' for enhancing the connection of the screws S. Once the length is set, the web member 51' is used in the same way as web member 51 for conventional trusses, as shown in FIG. 4B, or for wall bracing. The web member 51' has the advantage being able to be adjusted in length so that the angle of the tab 63' can be controlled so that it does not interfere with the end of the support section 58'.

Figure 7:
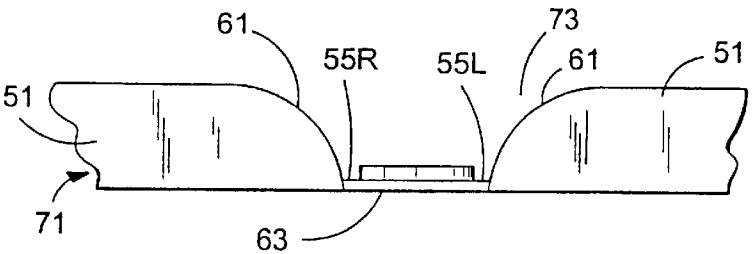
FIG. 7 is an enlarged fragmentary side view of a web member of the type shown in FIGS. 11A–11F.
Figure 8:
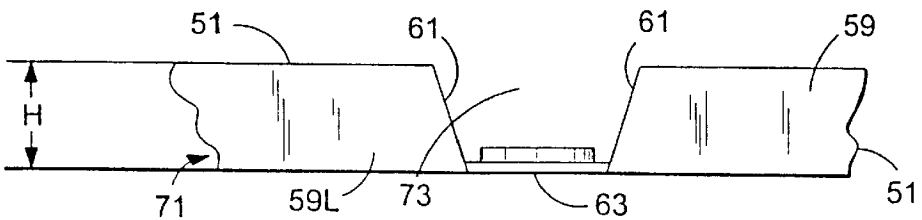
FIG. 8 is an enlarged fragmentary side view of a web member similar to FIG. 7 but showing a different shape of notch in a side wall.
Figure 9:
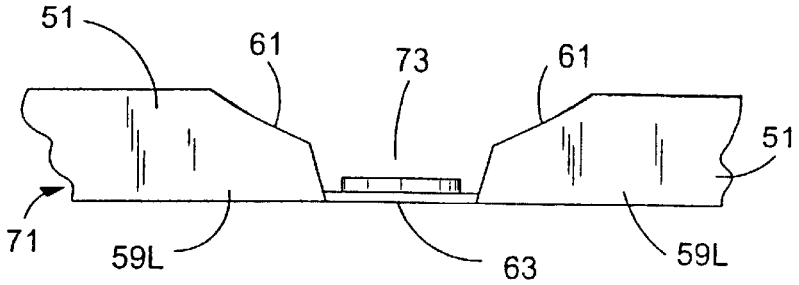
FIG. 9 is an enlarged fragmentary side view of a web member similar to FIGS. 7 and 8 but showing a still different shape of notch in a side wall.
Figure 10A:
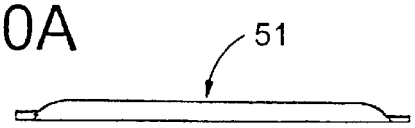
FIGS. 10A–10E are side views of a range of different lengths of web members of the type depicted in FIG. 4, for example 600, 900, 1200, 1800, 2100 mm long.
Figure 10B:
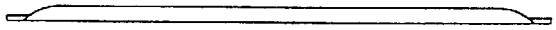
Figure 10C:
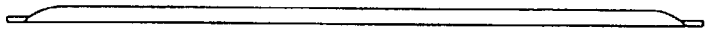
Figure 10D:
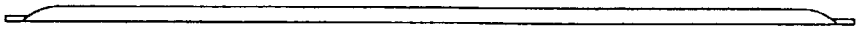
Figure 10E:
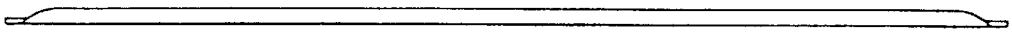
Figure 11A:
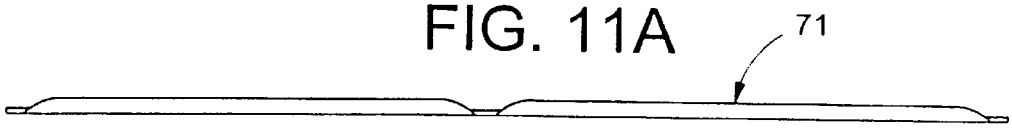
FIGS. 11A–11F are side views of the type of web member with multiple interconnected sections of the type shown in FIG. 5 with section lengths of 600 plus 1200, 900 plus 1200, 1200 plus 1200, 1200 plus 1800, 1200 plus 2100 and 1800 plus 2100 mm long as examples.
Figure 11B:
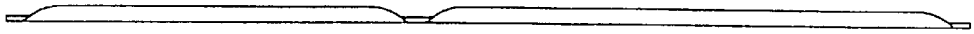
Figure 11C:
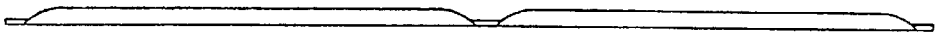
Figure 11D:
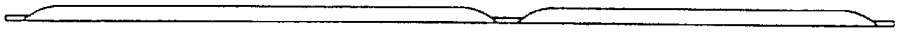
Figure 11E:
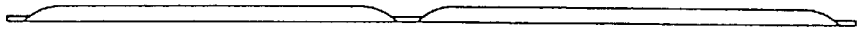
Figure 11F:
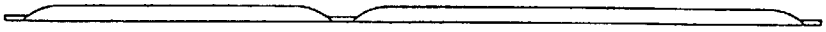

The web member 71 (FIGS. 5, 11A–11F and 14)is similar to the construction of the web member 51. The web member 71 is essentially a series of two or more connected webs 51 wherein a plurality of central support sections 58 are connected together. The connection is provided by a common tab 63 attached to and extending between adjacent end-to-end web central support sections. Two or more sections may be provided. A series of web members 71 are shown in FIGS. 11A–11F, each being comprised of a connected pair of support sections 58. The truss of FIG. 3 illustrates a web 71 with four support sections 58 connected by tabs 63. The sections 58 may be formed separately and secured together but in the preferred embodiment, are formed form the same piece of material, so that the tabs 63 of adjoining sections are not structurally distinct. Notches 73 (FIGS. 7, 8 and 9) are defined by the adjacent contoured ends 61 of the sections 58 and allow bending of the tabs 63 in both a forward direction (the ends 61L, 61R on opposite ends of a notch move closer together) and a rearward direction (the ends 61L, 61R on opposites ends of a notch move apart) for securement of a web member to chords as described hereinafter. The notches 73 allow for easy bending at the tabs 63 and prevent interference between the ends of the walls 59 when the bend is a forward bend.

Figure 17:
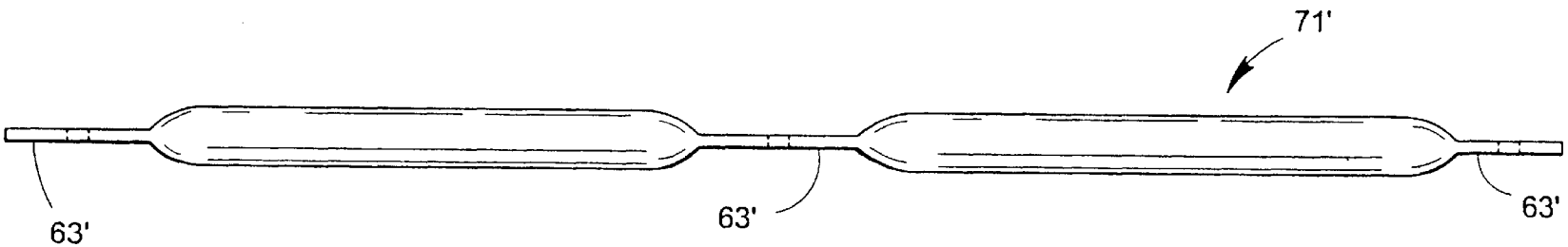
FIG. 17 is a side elevation of a modified form of a web member made from a tube.
Figure 19:
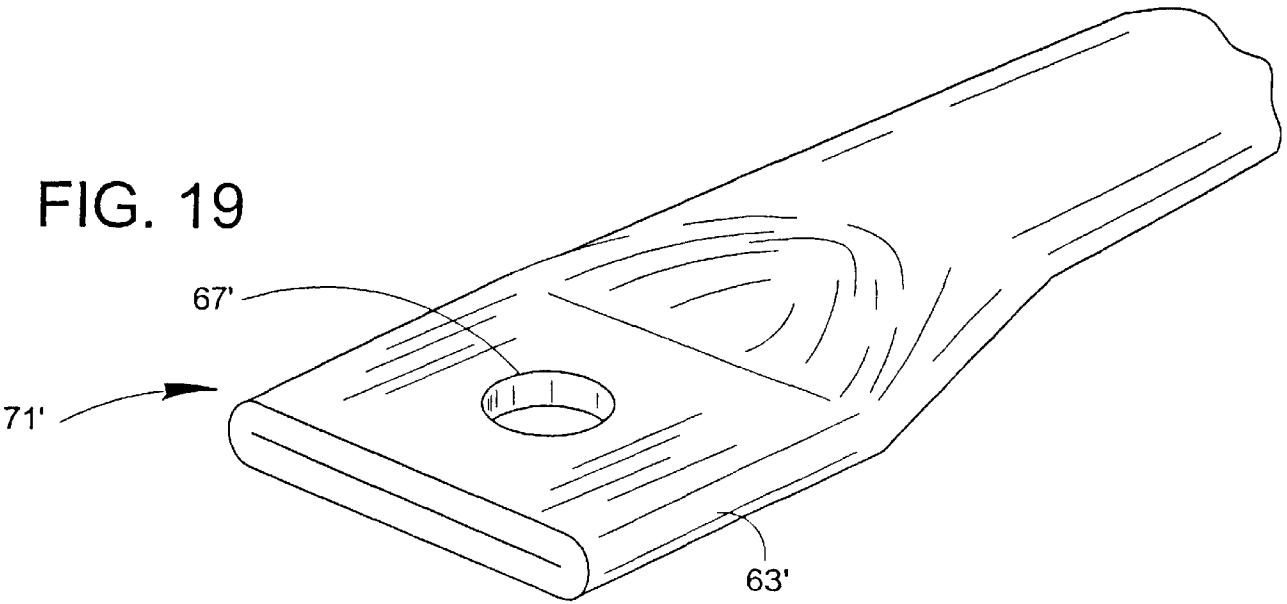
FIG. 19 is an enlarged, fragmentary portion of an end of the modified web member of FIG. 17.
Figure 18:
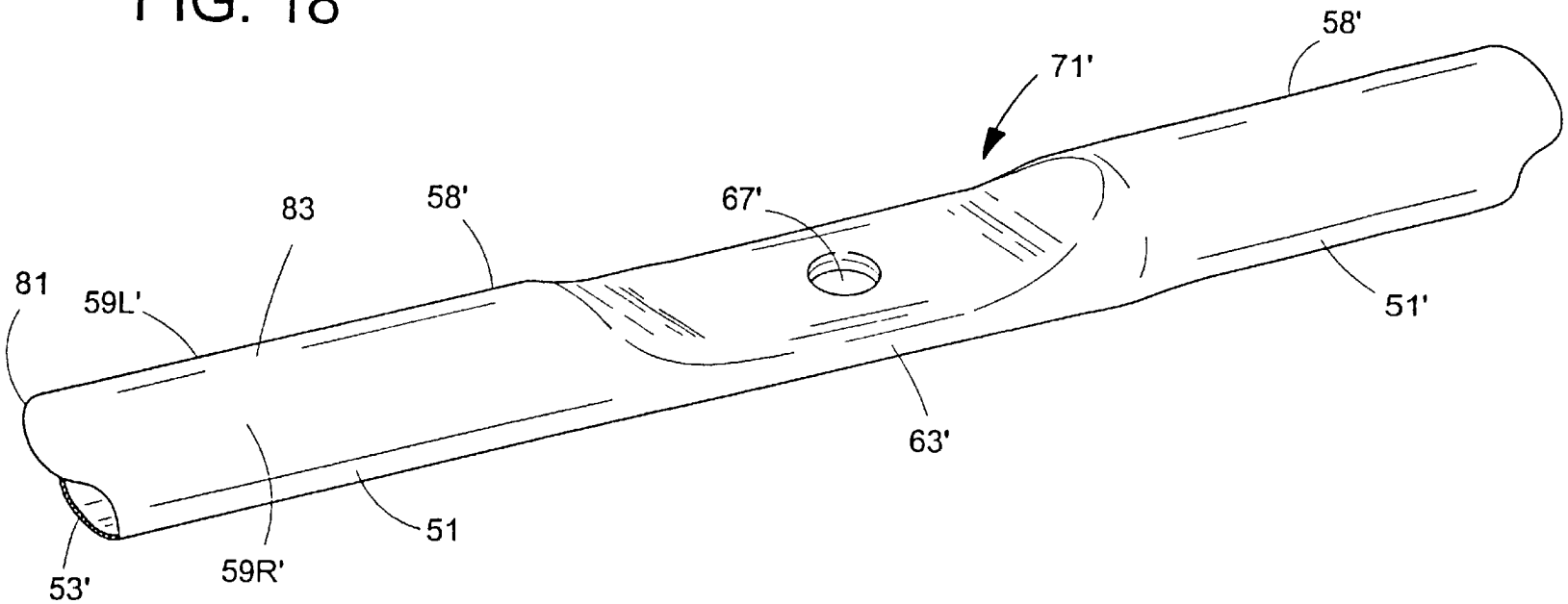
FIG. 18 is an enlarged, fragmentary portion of the modified web member of FIG. 17 at a central portion.

A modified form of web member is shown in FIGS. 17–19 with parts similar to the parts of the web 71 being shown with a prime superscript for clarity. The web 71' is formed from a tube 81 with the tabs 63' being formed by deforming (flattening) a short length of the tube. An aperture 67' is formed in the tab 63'. In this embodiment, the sidewalls 59L', 59R' are the more upright portions of the perimeter of the tube. The bottom wall 53' is the lowermost portion of the tube perimeter. The web member 71' has a top wall portion 83 which is the uppermost portion of the perimeter of the tube. Preferably, the tube is generally round in transverse cross section except in the deformed areas forming the tabs 63'. However, the tube may have other cross sectional shapes, such as rectangular or oval, without departing from the scope of the present invention.

Figure 13:
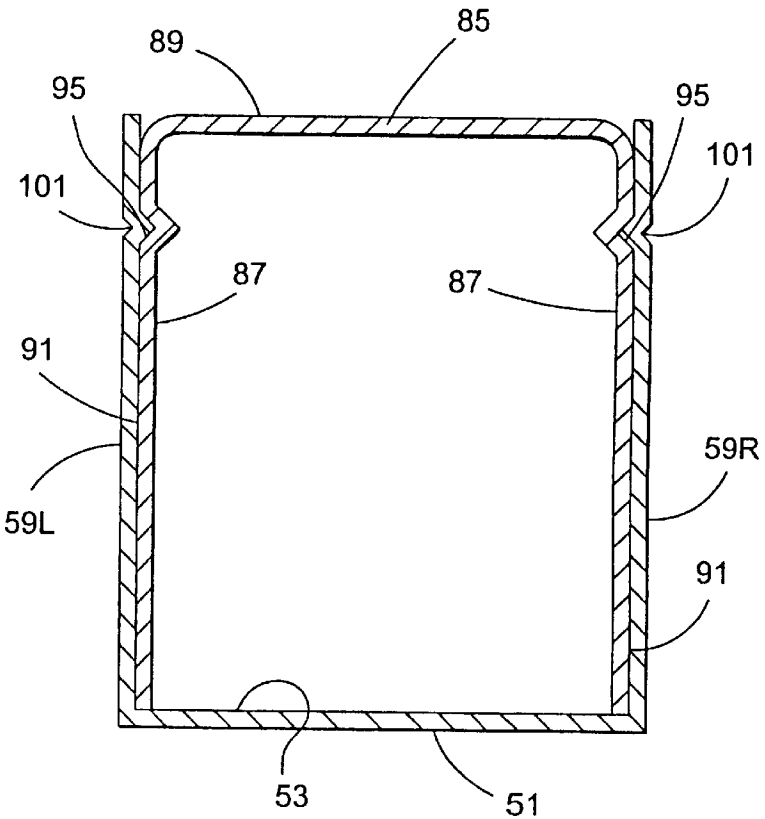
FIG. 13 is an enlarged section view of the web and reinforcing member taken along he line 13—13, FIG. 14.
Figure 12:
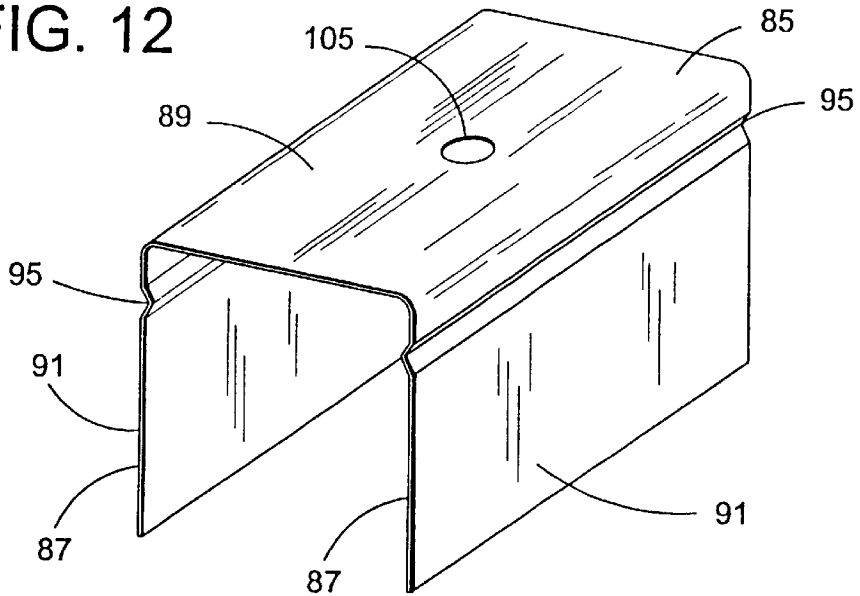
FIG. 12 is a perspective of a reinforcing member for use as shown in FIGS. 13 and 14.
Figure 14:
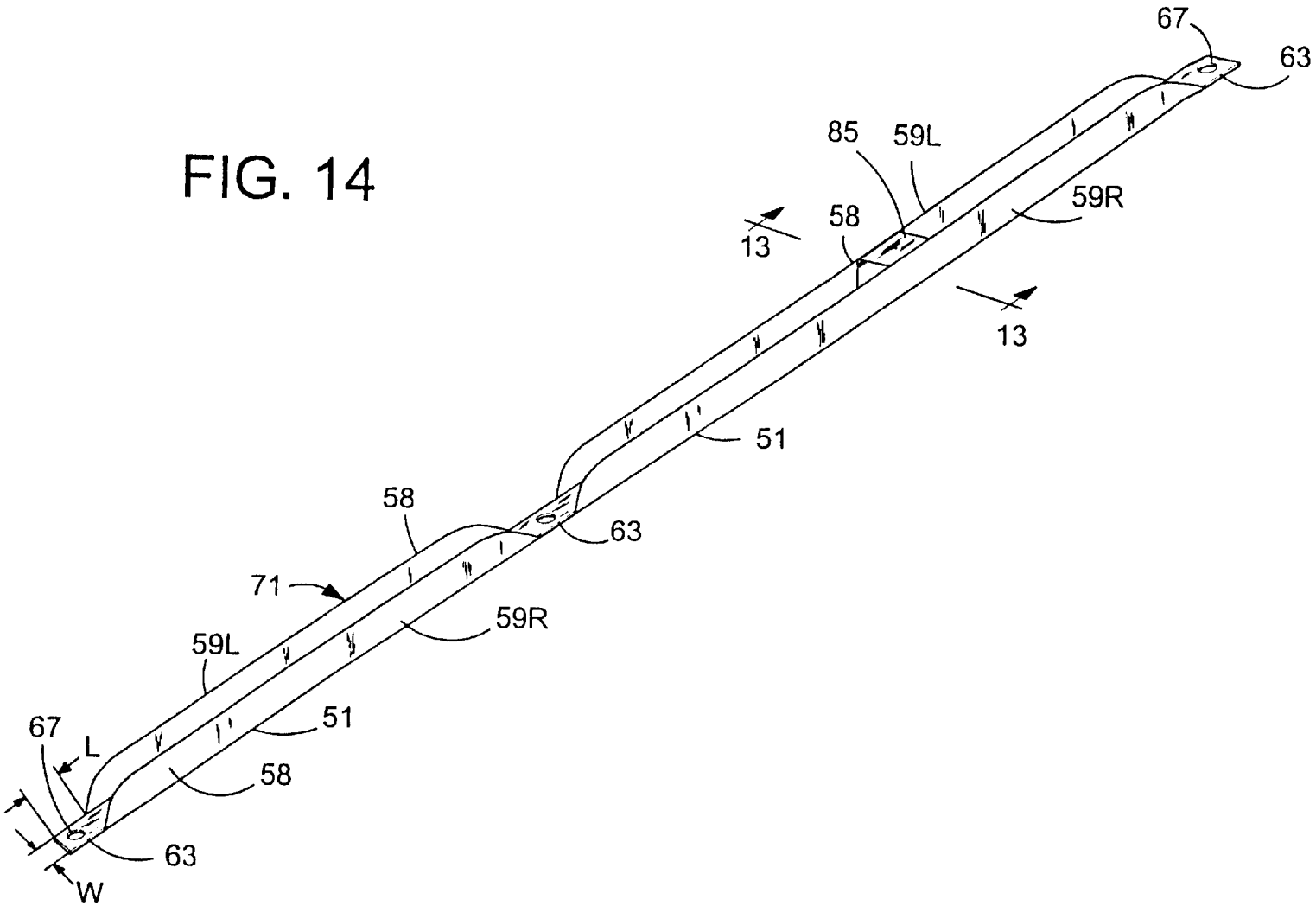
FIG. 14 is a perspective of a web member with an installed reinforcing member.

During loading of an open top (channel shaped) web member 51 or 71 in compression, the side walls 59L, 59R may deflect toward or away from one another. A slight inner directed curvature could be provided in the side walls to induce inward deflection during compression loading. A reinforcing member 85 is provided to resist such deflection and is illustrated in FIGS. 12, 13, 14. The reinforcing member 85 has a pair of flanges 87 connected to and projecting generally at right angles from a central connecting wall 89. The outer surfaces 91 of the flanges 87 are spaced to snugly fit between the inside surfaces of side walls 59 for a friction fit therebetween. The flanges 87 are each provided with an elongate outwardly opening groove 95 extending along the length of the member 85 at a position adjacent the junction between the central wall 89 and the flanges 87. When a reinforcing member 85 is installed in a web member 51 or 71, the grooves 95 are adjacent free edges of the side walls 59. The flanges 87 have a height substantially equal to the height of the wall 59 so that an outside surface of the flanges is flush or slightly above flush with the free edges. The side walls 59 are bent to form inwardly directed protuberances 101 (FIG. 13) that can be in the form of longitudinally extending ribs or localized ridges or dimples spaced along the length of the side walls. The protuberances 101 project into the grooves 95 for releasably retaining the member 85 in the support section of the web member 51 with a snap lock connection. An aperture 105 can be provided in the central wall 89 for the attachment of laterally extending intertruss braces or additional web members to sections (not shown) of the web member 71 or between web members 51 for additional bracing.

Figure 20:
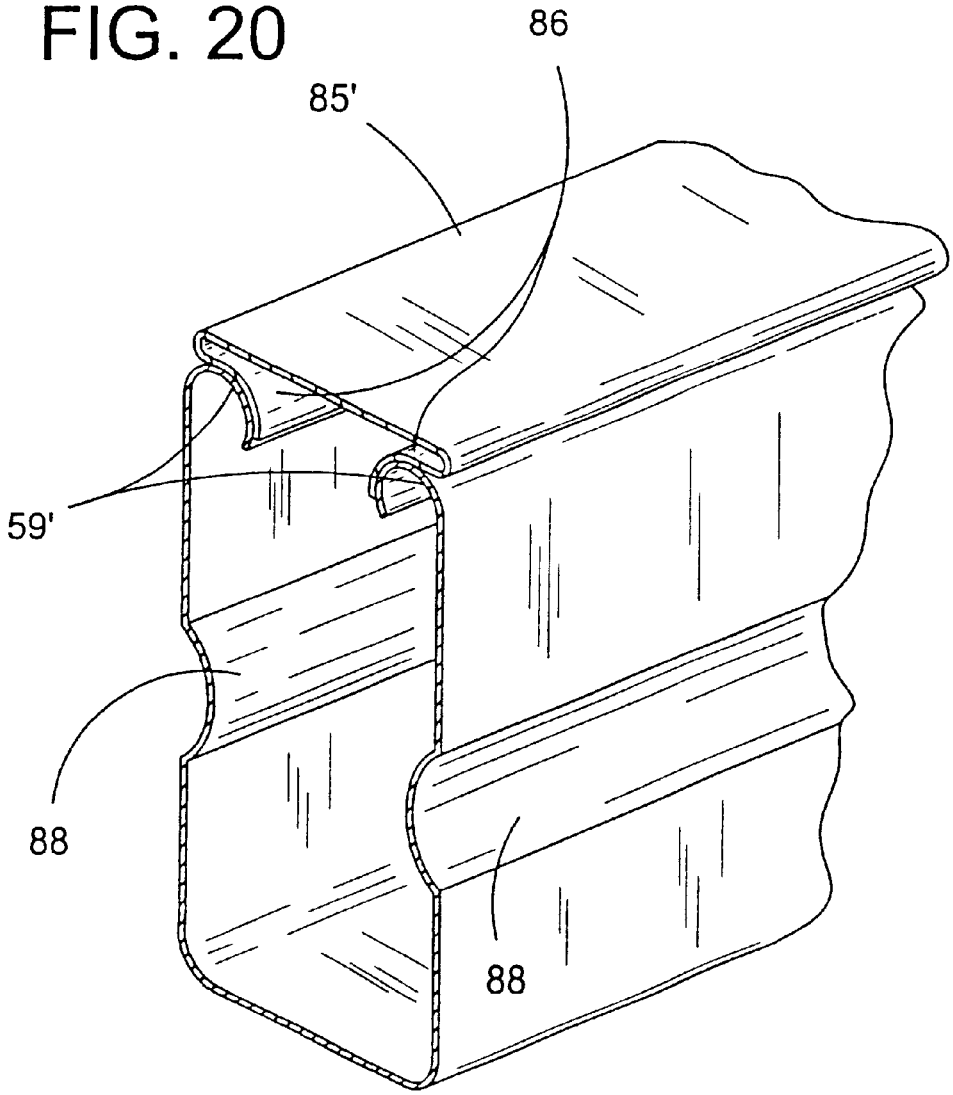
FIG. 20 is a fragmentary portion of a web member configured for greater strength if of a longer span using a capping member.

Reinforcing member 85 can be utilized once or at several different positions on longer spans. There may be a case for providing a more aesthetic box section for longer sections while at the same time providing a greater measure of rigidity. If desired the web member can be provided with, for example, the in turned flange type forms 59' depicted in FIG. 20. These flange like forms 59' can be complemented by appropriate flanges 86 of a capping member 85' which can (if desired) run for the full extent or substantially the full extent of the web member. The flanges 86 bear against the flange like forms 59' to retain the capping member 85' in place. It is within the scope of the present invention to connect the capping member 85' to the web member by fasteners or by welding (not shown). The side walls of the web member of FIG. 20 are formed with ribs 88 to further increase their strength.

Figure 15:
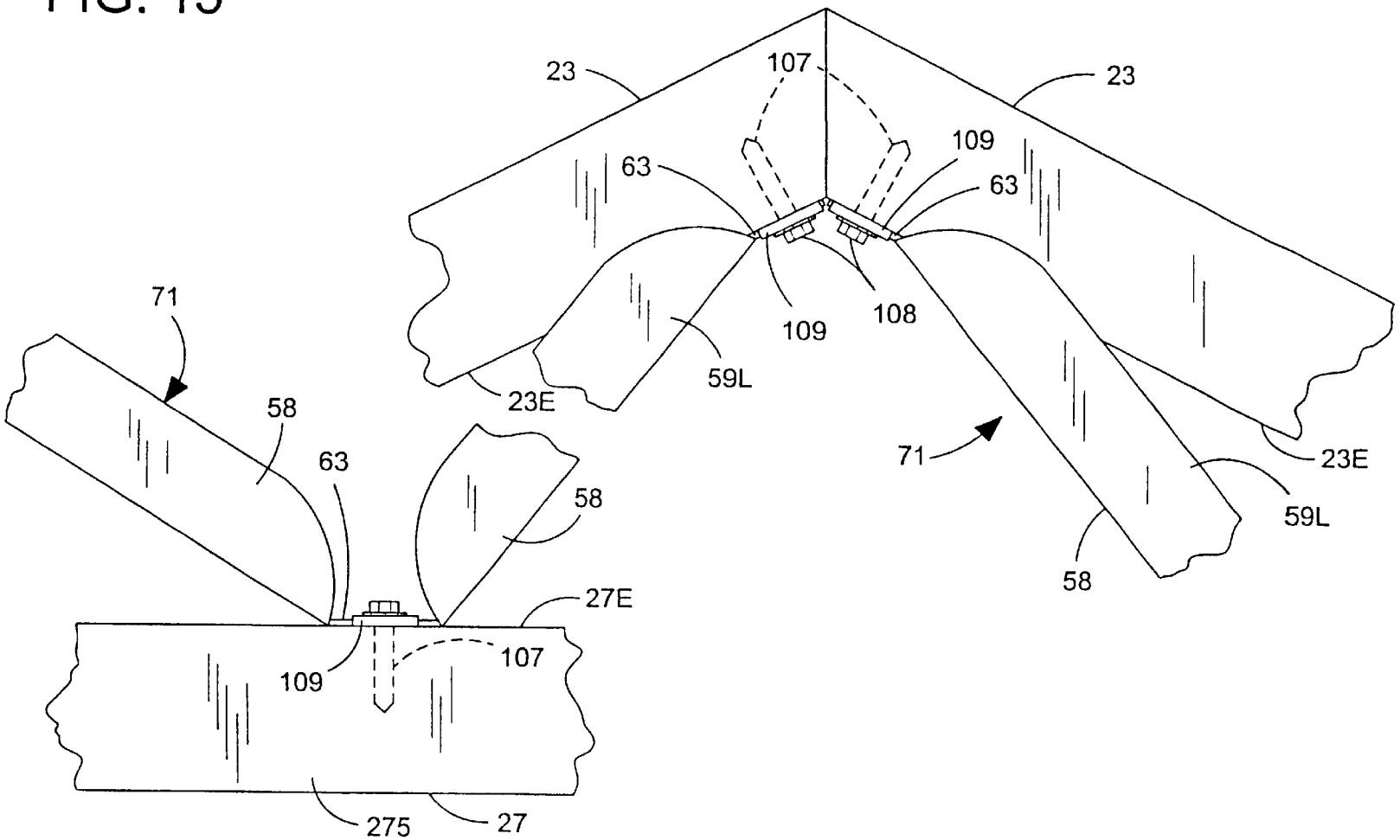
FIG. 15 is an enlarged fragmentary side view of the connection of web members to top and bottom chord members of a pitched roof truss.
Figure 16:
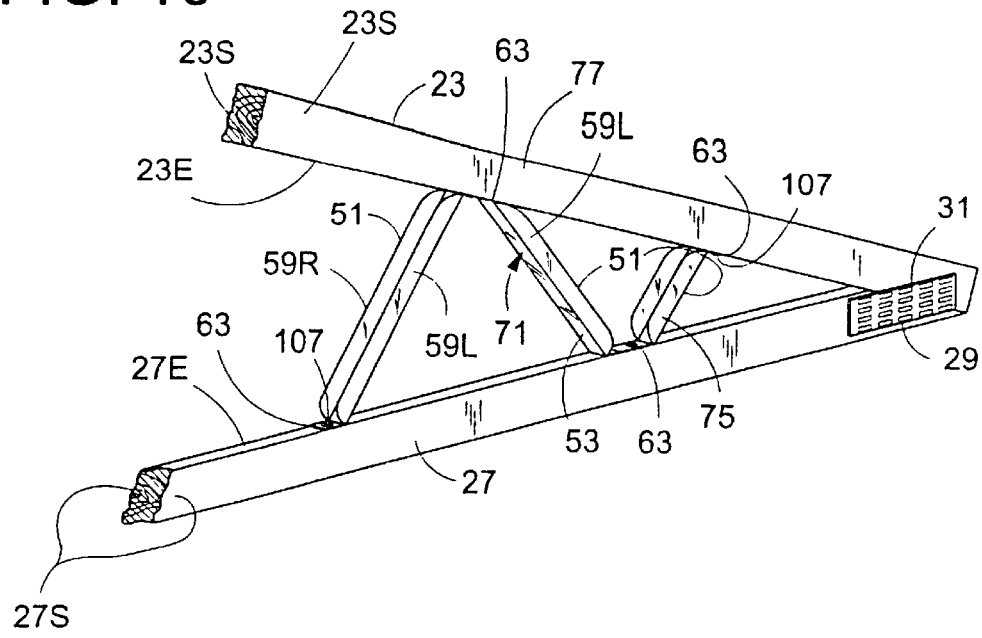
FIG. 16 is an enlarged fragmentary perspective of a pitched roof truss showing forward and reverse bends in the web member.
Figure 16A:
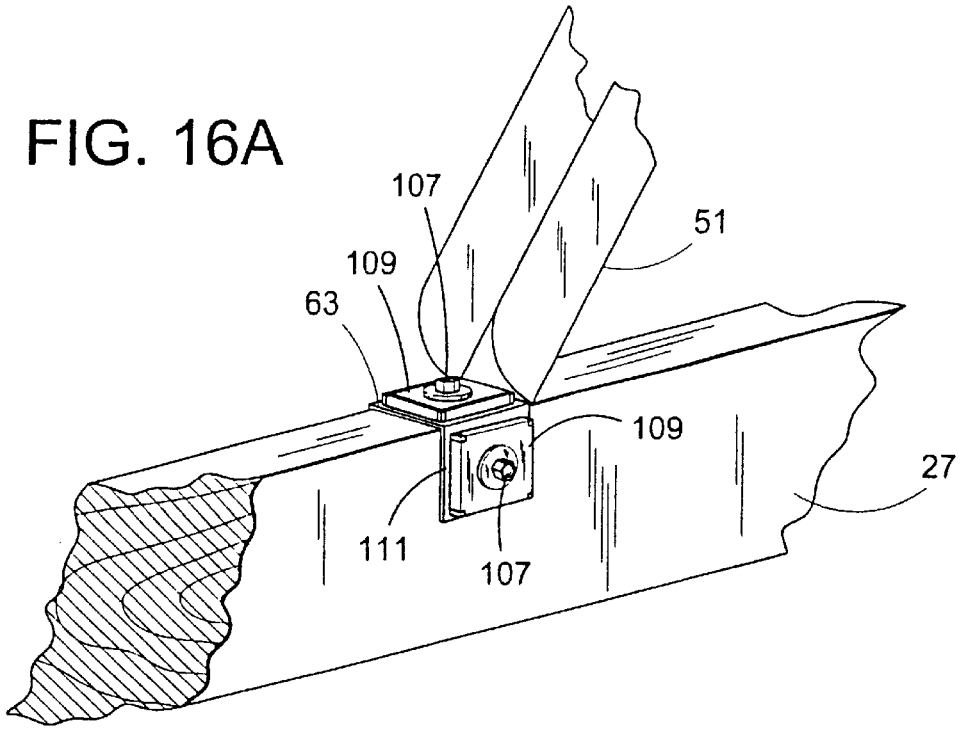
FIG. 16*a* is a further enlarged fragment of FIG. 16, but showing a web member having an ear to augment attachment.

In the construction of a truss, the various chords are joined together in any suitable manner to form the perimeter shape of the truss. The desired web member 51, 71 or 71' is selected and the tabs 63' are bent relative to the central support sections to overlie and engage the inside chord edges, e.g., 23E, 27E, for attachment at predetermined locations therealong. Referring to FIGS. 15, 16 and 16A, web member 71 is secured to at least two chords by driving a fastener 107, such as a screw fastener, through each of the apertures 67, of the tabs 63. The fasteners 107 have enlarged heads 108 that each overlie a respective tab. A washer 109 may be provided for each fastener 107 to help stiffen and strengthen the tabs 63, to reduce bending or fastener tear through and is captured between a respective head 108 and tab. The longitudinal axis of each of the fasteners 107 lies in a plane generally parallel to the plane of the respective truss 21A–C formed by the chords. The plane of a truss (FIG. 16) is a plane extending between opposite ends of the truss and bisecting the truss between the opposite side faces, e.g., 23S, 27S. Alternatively, the truss may be considered as including two planes, each including respective side faces 235, 275 of the chords 23, 27. The longitudinal axis of the fastener 67 is also generally parallel to the opposite side faces, e.g., 23S, 27S of a chord into which they are screwed. If desired, additional fasteners may also be used to secure the side walls 59 of the web members 51, 71 where they overlap the side edges of the chords. The lengths of the central support sections of the web members are preferably sized so that the tabs 63, will be located on the chords at desired locations for appropriate bracing of the chords. The notches 73 can be formed by removal, e.g. cutting, of material from the sheet material from which the web member 71 is made. In an alternate embodiment, the sheet may be cut to form the end edges of the side walls 59 leaving the material connected at one edge to the tab 63 to form an ear 111 (see FIG. 16A) which may also be used to help secure the web member to a chord with an additional fastener 107. The ear 111 is bent down over the side 275 of the chord 27 as shown in FIG. 16A. Such an arrangement would be useful when there is insufficient room in the inner space 43 to use a fastener driver.

Figure 21:
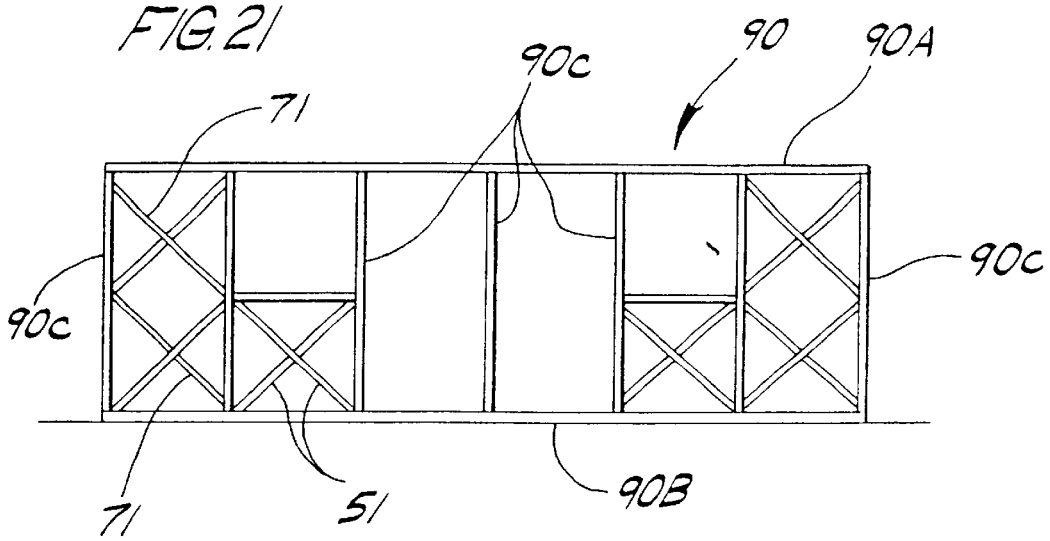
FIG. 21 is a side elevation with reference to load direction (horizontal load direction) of a structure having timber studs braced by webs in accordance with the present invention.
Figure 22:
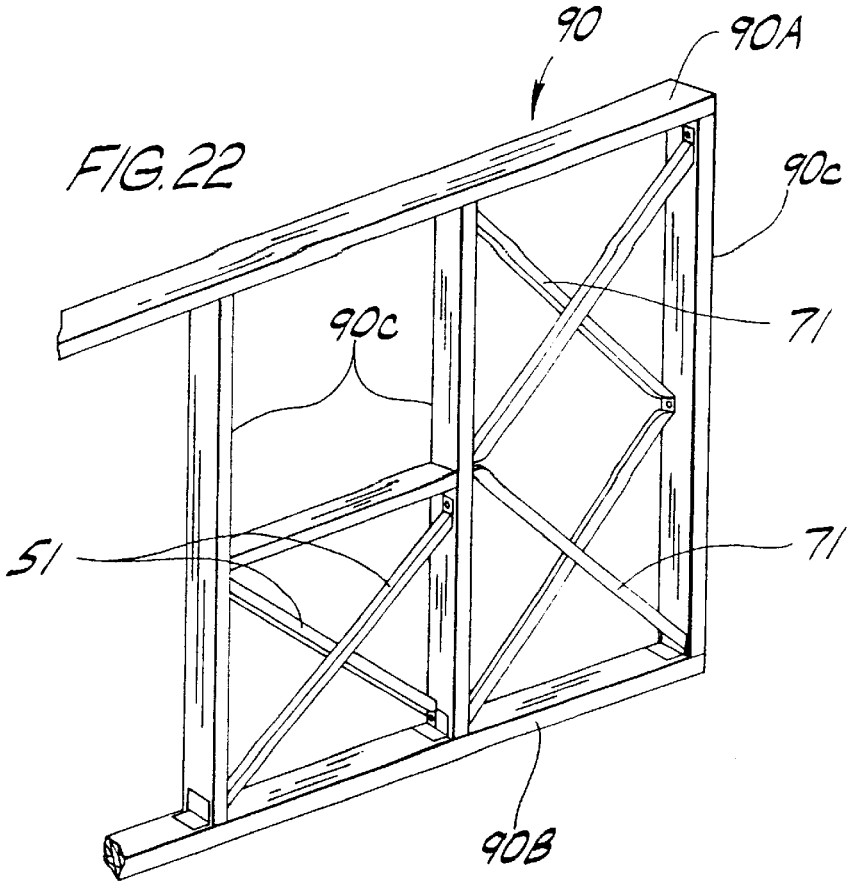
FIG. 22 is an enlarged, fragmentary perspective view of the arrangement showing part of the structure as shown in FIG. 21.

Referring now to FIGS. 21 and 22, web members 51, 71 of the present invention are shown as employed in a wall frame 90 including a top plate **90*a*, a bottom plate 90*b* and studs 90*c* extending between the top and bottom plates. In this embodiment, adjacent studs constitute the first and second beams. The web members 51, 71 extend generally from side to side instead of top to bottom as when used in trusses. The web members 51, 71 brace the wall frame 90 against lateral or shearing forces on a wall of a building, such as may be experienced during an earthquake or in high winds. The web members 51, 71 may be secured to the studs 90*c*** in the same way as they are secured to the chords of the trusses described above.

Figure 27:
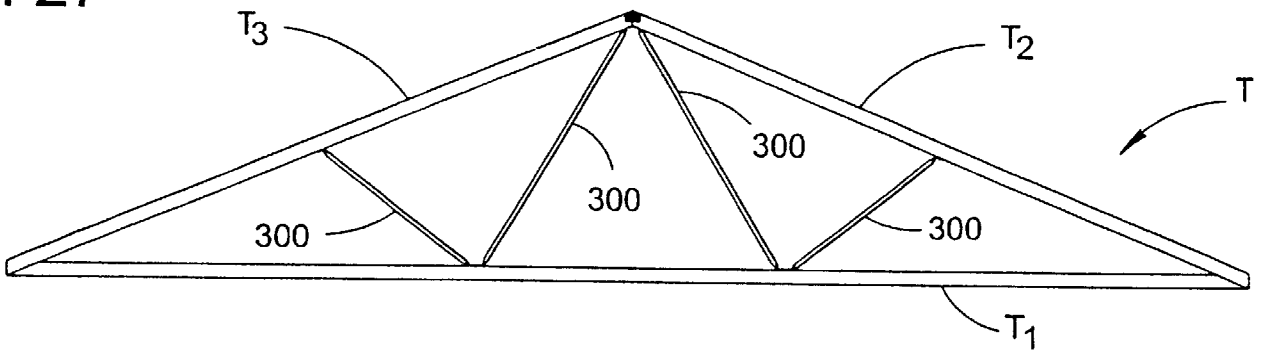
FIG. 27 is a view of a building truss using metal webs of the type described with reference to FIGS. 23 to 26.

With reference to FIG. 23 a metal web 300 for a building truss T shown in FIG. 27 is closely related to the metal web 71' shown in FIGS. 17–19 above. The metal web 300 is formed from a metal tube 301 which is preferably of generally circular cross-section. The metal tube 301 may form a complete cylindrical structure and be formed in a rolling process with edges of the blank from which the tube 301 is formed being welded or otherwise joined together to form a tube 301 having a continuous circular or cylindrical wall. However, it is to be understood that tubes (not shown) of non-circular cross section may be used without departing from the scope of the present invention. In other embodiments the tube 301 can be rolled so that edges of the blank from which the tube is formed are merely adjacent one another without being joined together thereby forming a longitudinal slot which extends the length of the tube. The web 300 can be formed in stock lengths commencing at a length of 300 mm with stock lengths increasing in length by 150 mm up to a maximum length of 2900 mm. These stock lengths are merely exemplary and obviously other stock lengths and increments could be used if desired.

The web 300 has securing tabs 302 formed at least at one end. In the preferred embodiment each end has a securing tab 302 as clearly shown in FIG. 23. The manner in which the securing tabs 302 are formed will be described in detail hereinafter with reference to FIGS. 40 to 58. The securing tab 302 comprises a generally flat tab portion 304 which has a hole 305 for receiving a fastening screw S (see FIGS. 28 to 30 for example). The tab portion 304 is formed symmetrically with respect to the cylindrical tube 301 as is best shown in FIG. 23.

The flat tab portion 304 merges into the tube 301 at a transition section 306. The flat tab portion 304 is generally formed by diametrically opposed semi-cylindrical surface portions of the tube 301 by squashing or flattening those portions together as will be described with reference to FIGS. 40 to 58. The transition section 306 comprises opposed valleys 308 which extend axially inwardly from the tab portion 304 and merge with a deformed part 301*a* of the tube 301. Each valley 308 is located between a pair of ridges 309 (as best shown in FIG. 24) which incline outwardly from the tab portion 304 to the non deformed portion 301*a* of the tube 301. As best seen in FIG. 24, the valleys 308 taper from a generally wide entrance portion 310 to a narrower end portion 311 with the entrance portion 310 being adjacent the tab portion 304 of the tab 302. Each pair of ridges 309 has side walls 312 which merge with the floor 307 of the valley 308. The side walls 312 are joined by a curved transition wall 312*a*.

Figure 25:
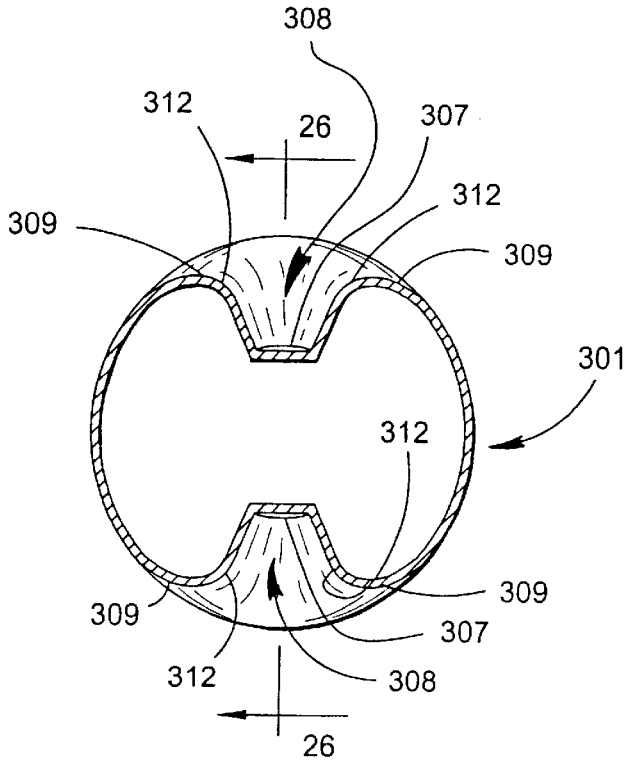
FIG. 25 is a cross-sectional view along the line 25—25 of FIG. 24.

Ends of the ridges 309 adjacent tab portion 304 have sloping end surface portions 313 which slope down to the tab portion 304. Tab portion 304 has a neck 304*a* which projects inwardly to the entrance 310 of the valley 308 and the floor 307 of the valley 308 inclines upwardly from the end of the neck 304*a* to the wall 312. The walls 312 in cross-section transverse to the longitudinal axis of the web 300 are slightly rounded so as to form a relatively smooth transition from the ridges 309 to the wall 312 and then into the floor 307 upon deformation of the tube 301 to form the valleys 308 and ridges 309, as best shown in FIG. 25.

As is clearly shown in FIG. 24 the tab section 304 is no wider in the direction of double headed arrow W1 in FIG. 24 than the diameter of the tube 301. Thus the tab section 304 is within the confines of the tube 301 and does not project radially or diametrically beyond the tube 301. This is important in the formation of building trusses because it enables the chords of the building truss to be the same size as the diameter of the tube 301, or alternatively, the tube 301 to be the same size as the chords of the building truss, so that the web 300, and in particular the tab portion 304, does not project beyond the planes of the chords of the building truss. This prevents interference with other framing or building components of a building to which the building truss is to be used and facilitates stacking. The manner in which the tab portion 304 is retained within the confines of the tube 301 so it does not project beyond the diameter of the tube 301 will also be described in detail with reference to FIGS. 40 to 58. The transition between the flat tab portion 304 and the sloping surfaces 313 of the ridges 309 form a hinge line 314 along which the tab section 304 can bend relative to the tube 301 to angle the tab section 304 at a predetermined angle with respect to the tube 301 for flat, face-to-face engagement with a chord of a building truss.

Figure 26:
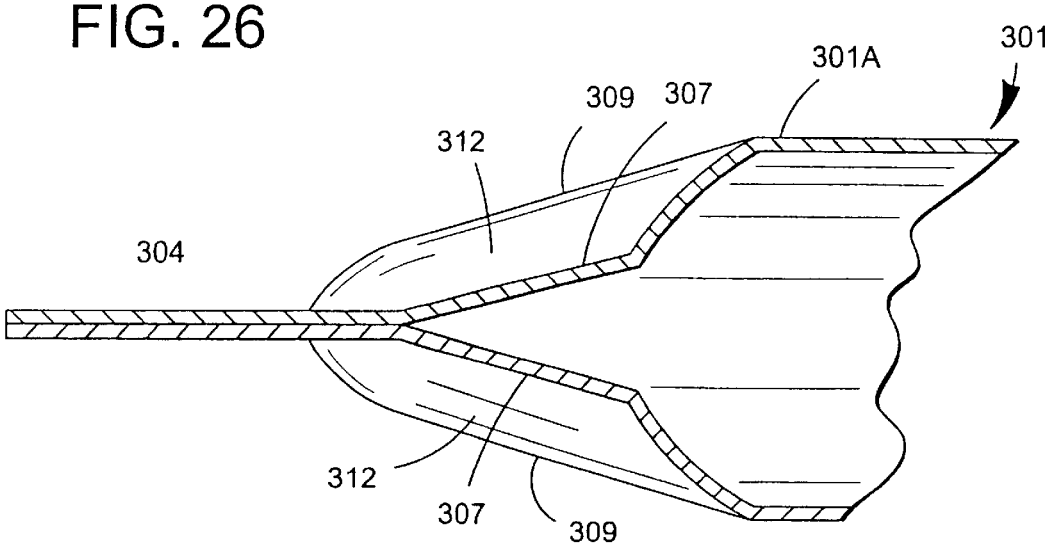
FIG. 26 is a view along the line 26—26 of FIG. 25.
Figure 26A:
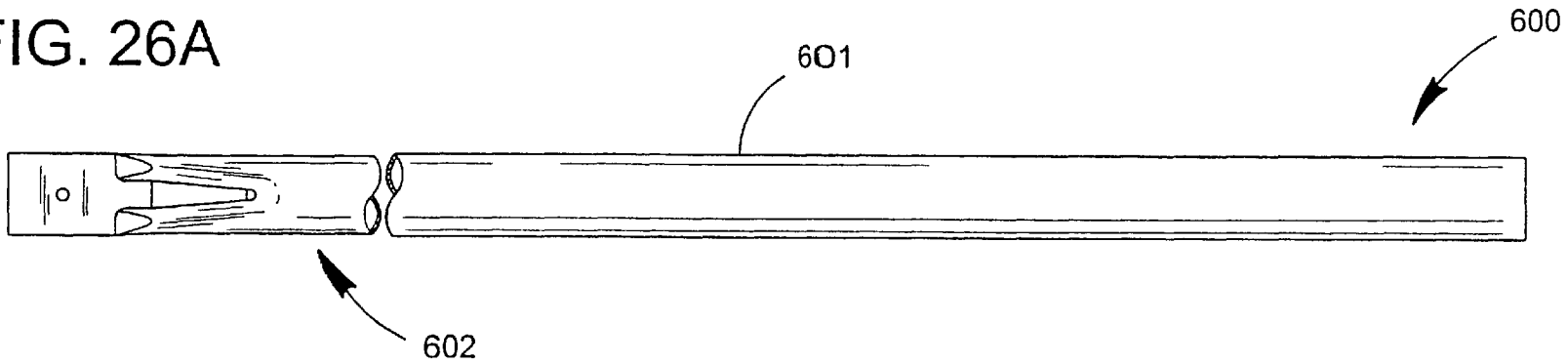
FIG. 26A is a plan view of an extension piece which can be used with the embodiment of FIGS. 24 to 26.
Figure 26B:
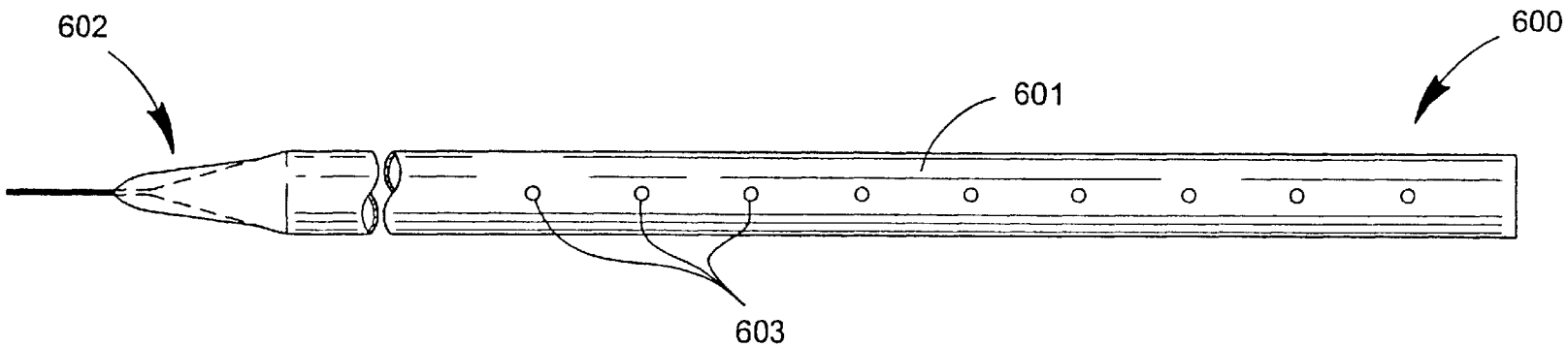
FIG. 26B is a side view of the extension piece of FIG. 26A.

FIGS. 26A and 26B show an extension piece 600 which can be used with the embodiment of FIGS. 23 to 26. The extension piece 600 is formed from a tubular member 601 which has an internal diameter slightly greater than the external diameter of the web 300 so that the tube 601 can slide over the web 300 (including the tab 302). The tube 601 is formed with a tab 602 which is identical in configuration to the tab 302 previously described except that it is slightly larger because of the slightly larger diameter of the tube 601. The tube 601 is provided with a plurality of holes 603 along its length and the tube 301 of the web 300 can also be provided with a number of holes (not shown) along its length at least adjacent the tabs 302. Alternatively, the web 301 could be provided with a single hole. In still an alternative arrangement, the extension piece 600 could be provided with a single hole 603 and the tube 301 of the web 300 provided with a number of holes along its length adjacent the tab 302. In a most preferred embodiment, the extension piece 600 is provided with one or more holes 603 and the tube 301 has no holes. The extension piece 600 is located in the desired position on the tube 301 and a self tapping screw is driven through the hole 603, forming its own hole in the tube and securing the tube 301 and extension piece 600 in the desired position.

The extension piece 600 enables the length of the web 300 according to FIGS. 23 to 26 to be adjusted by sliding the extension piece 600 over the tab 302 and onto the tube 301 of the web 300 at one of the ends of the web 301. The extension piece 600 is then secured in place by locating a screw through one of the holes 603 of the extension piece 600 and into a hole in the tube 301 of the web 300 so as to securely fasten the extension piece 600 at the required position on the tube 301 to extend the length of the web 300 to a desired length. The extension piece 600 may have a length of, for instance, about 400 mm. This embodiment of the invention enables the length of the webs 300 to be extended by use of only a single piece and therefore decreases the number of stock lengths which may be required and also the number of components which are required in order to form a web 300 of a required length. The extension piece 600 provides a substantially infinite adjustment of the length of the web 300 by sliding the extension piece relative to the tube 301.

Figure 29:
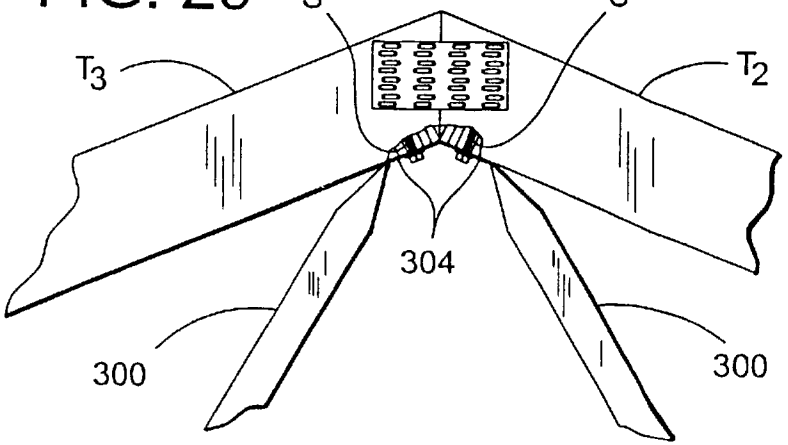
FIGS. 28, 29 and 30 are enlarged, fragmentary views of portions of the truss of FIG. 27.
Figure 28:
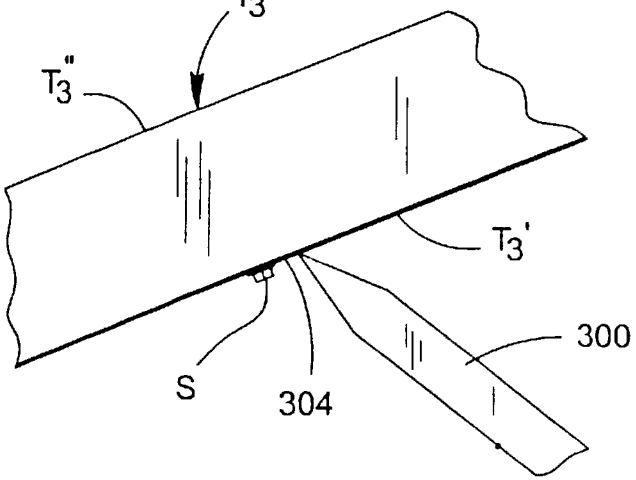
Figure 30:
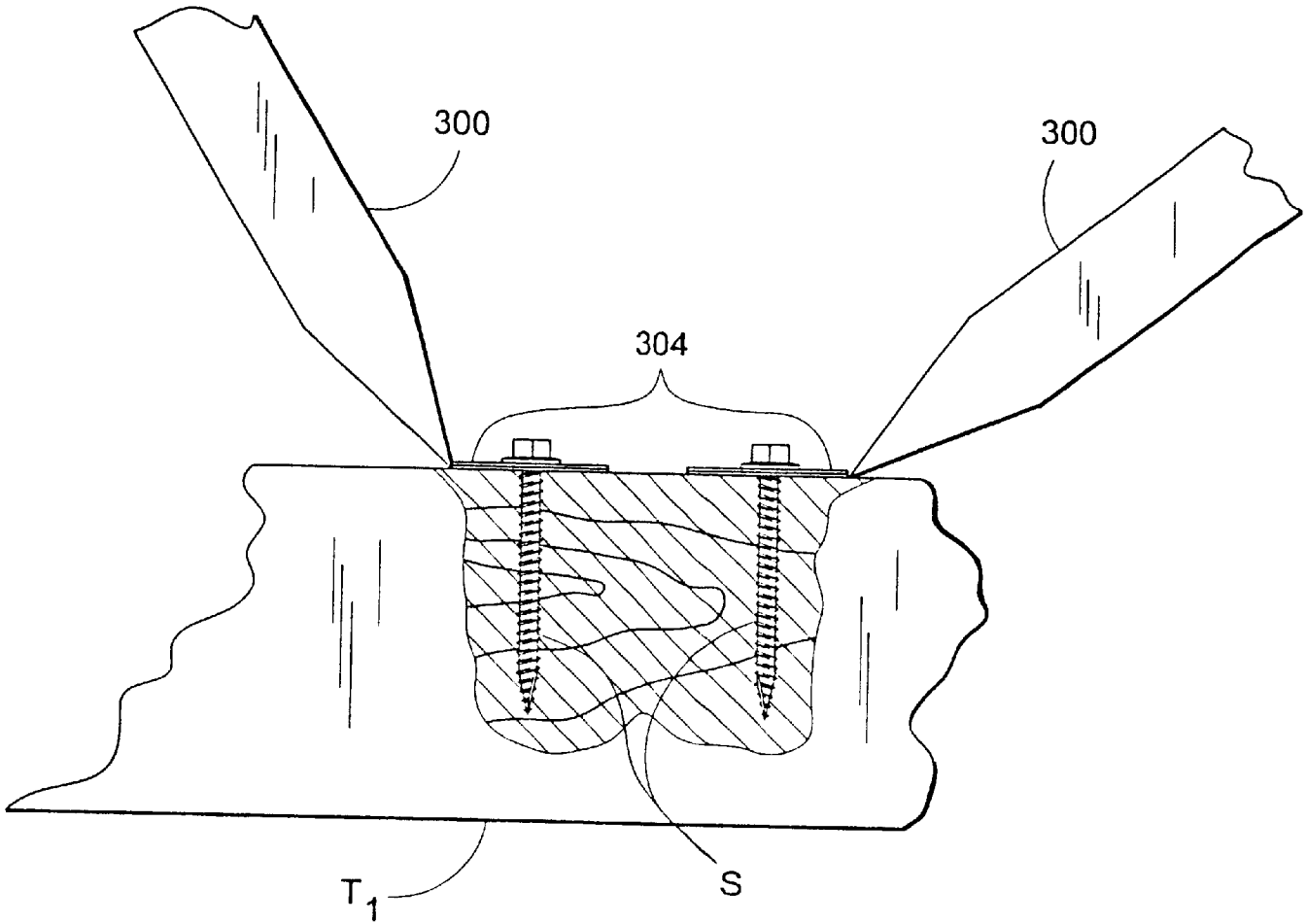

FIG. 27 shows a building truss T according to one embodiment of the invention which includes metal webs 300 of the type described with reference to FIGS. 23 to 26. The truss T has a bottom chord T1 and upper chords T2 and T3 which are arranged at oblique angles with respect to the chord T1. Webs 300 extend between the chords T1 and T2 and T3 as shown. As best shown in FIG. 28 the tab portion 304 has been bent an angle of almost 90 so that it will lay flat against surface T3' of the chord T3. FIGS. 29 and 30 show details of how tab portions 304 are bent at desired angles so that they will lay flat against the other chords T1 and T2 to enable securement of the webs 300 to the chords T1, T2 and T3.

The tab portion 304 is bent relative to the tube 301 by abutting the tab portion against part of the chord T1 and moving the tube 301 so as to bend the tab portion about the hinge line 314. The wall thickness of the tube 301 is relatively thin and therefore the tab 304 itself is relatively thin and can be bent relatively easily by manual force if desired. In other embodiments the tab portion section 304 could be already provided with a slight bend in one direction or the other so as to facilitate more easy bending of the securing section 304 to the desired angle relative to the tube 301 for location flush with a chord T1, T2 or T3.

As particularly shown in the more detailed FIG. 30, the webs 300 do not actually come into contact with one another or abut one another at positions where they meet the chords T1, T2 or T3. In conventional wooden trusses it is usual that the wooden webs solidly abut and contact one another at positions where they are joined to the chords T1, T2 or T3. The reason for this is that the contact of the webs with one another takes some of the load applied through the chords T1, T2 and T3 and therefore distributes the load through both of the webs to or from the chords T1, T2 or T3. However, in accordance with the preferred embodiment of the present invention the securing tab 302 is designed to operate in isolation in both compression and tension. The securing tab 302 which joins the webs 300 to the chords T1, T2 and T3 is sufficiently strong to take all of the required load and therefore does not require the webs 300 to contact one another. Indeed, the webs can be spaced apart at their connections with the chords T1, T2 and T3 as is best shown in FIG. 30. The ability of being able to space the webs 300 from one another, rather than having them contact one another as in conventional wooden trusses, makes it easier to install the webs 300 in place and overcomes problems associated with precise lengths to ensure that webs do contact one another at the positions where they are joined to the chords T1, T2 or T3.

As previously described, the metal webs 300 are secured to the chords T1, T2 and T3 by self tapping screws S which are driven through the holes 305 in the tab portions 304 and screw into the wooden chords T1, T2 and T3. The preferred manner in which the self tapping screws S are driven into the chords T1, T2 and T3 to secure the webs 300 in place will be described hereinafter with reference to FIG. 39 and the preferred structure of the screws S will be described with reference to FIG. 59.

Figure 31A:
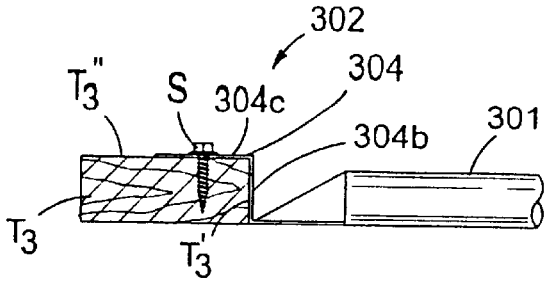
FIGS. 31A, 31B, 31C, 31D, 31E and 31F show various different tab configurations which can be used in the present invention.

FIGS. 31A to 31F show various tab configurations which may be embodied in the invention. In these Figures, rather than the tab 302 being symmetrical with respect to the tube 301, the tab 302 is formed to lie generally adjacent one peripheral portion of the tube 301 from which the web 300 is formed. In FIG. 31A the tab 302 has the tab portion 304 formed as a right angle having portions 304*b* and 304*c* with the portion 304*b* being adjacent inside edge T3' of chord T3 and the portion 304*c* being adjacent side T3' of the chord T3. The tab 302 is secured to the chord by a screw S passing through the opening 305 (not shown in FIGS. 31A–31F) in the tab portion 304 and the side T3" into the chord.

Figure 31B:
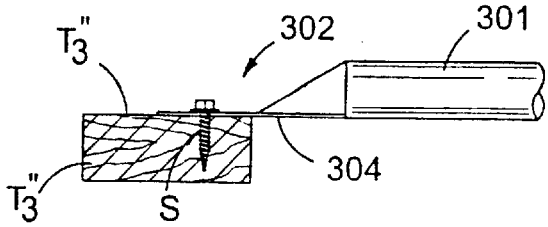
Figure 31C:
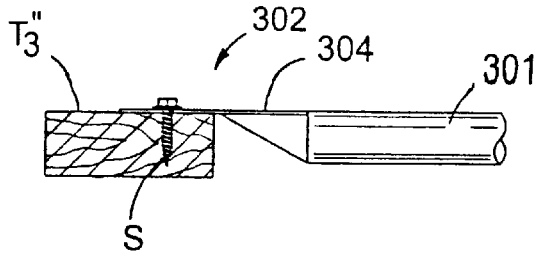

FIG. 31C shows the web 300 of FIG. 31B but fixed in a position with the tube 301 rotated 180° about its longitudinal axis with respect to the tube 301 shown in FIG. 31B. It will be understood that in FIG. 31B the web 300 lies entirely outside the planes of the chord T3' and in FIG. 31C the web lies entirely inside of the planes of the chord.

Figure 31D:
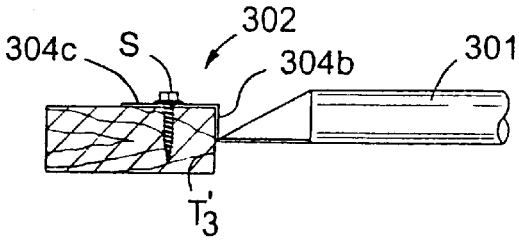
Figure 31E:
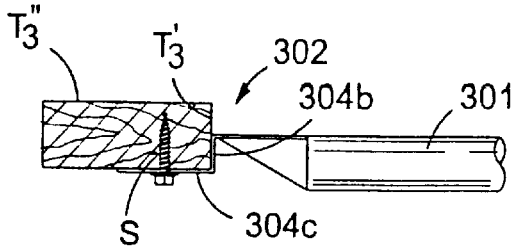

FIG. 31D is a view similar to FIG. 31A except that the portion 304*b* is somewhat shorter thereby locating the tube 301 slightly higher relative to the chord T3 than the position shown in FIG. 31A. FIG. 31E is a view of a web 300 similar to that shown in FIG. 31D except located on the face of the chord T3 opposite to the face T3". In other words, the configuration of FIG. 31D is simply rotated 180°.

Figure 31F:
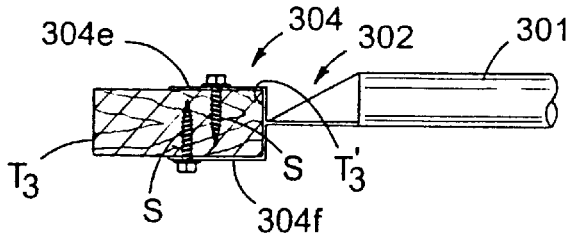

FIG. 31F shows an arrangement where the two opposed peripheral portions of the tube 301 which are compressed together to form the tab portion 304 are separated into two parts 304*e* and 304*f* so as to form a generally U-shaped channel configuration into which the chord T3 is located. A pair of screws S pass through holes similar to the hole 305 in the separate portions 304*e* and 304*f* to secure the web 300 to the chord T3.

The various embodiments with reference to FIGS. 31A–31F show different tab configurations which can be used to locate the web 300 at a desired position relative to a chord T3 should it be desired to provide the web 300 other than totally within the confines of the chords T1, T2 and T3 to, for example, provide additional space for other framing or component which may be used in the building.

FIGS. 31G to 31J show a still further embodiment of the invention in which the tube 301 is formed with a tab 302 which comprises a first gusset 609 and a second gusset 610. The gussets 609 and 610 are formed by slicing the tube 301 substantially parallel with the longitudinal axis of the tube 301 and flattening the two sliced portions of the tube 301 to form the gussets 609 and 610. The portion of the tube 611 adjacent the gussets 609 and 610 is then deformed in a somewhat similar manner to that described with reference FIGS. 23 to 26 so as to form a valley 615 on diametrically opposed sides of the tube 301 between the gussets 609 and 610. The valley 615 inclines outwardly from the gussets 609 and 610 to merge with the undeformed part of the tube 301.

Figure 31G:
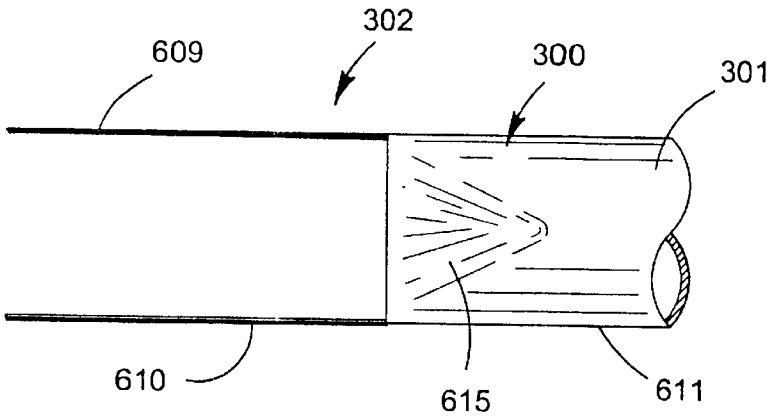
FIG. 31G is a plan view of a part of a web according to a further embodiment of the invention.
Figure 31H:
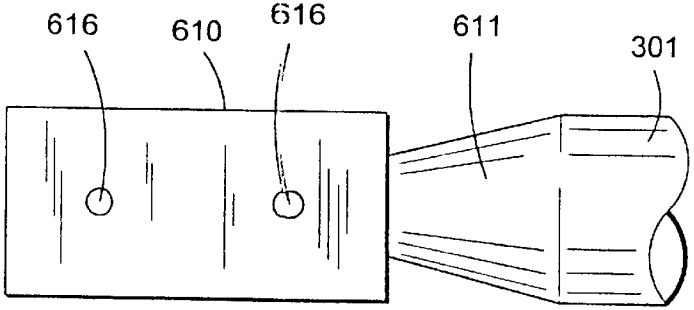
FIG. 31H is a side view of the part of the web of FIG. 31G.
Figure 31I:
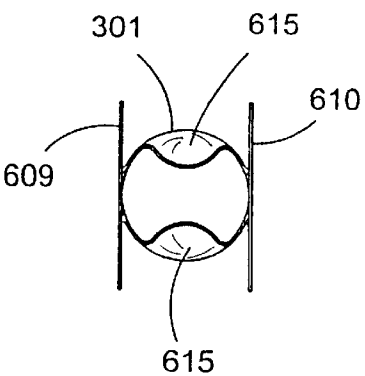
FIG. 31I is an end view of the part of the web of FIG. 31G.
Figure 31K:
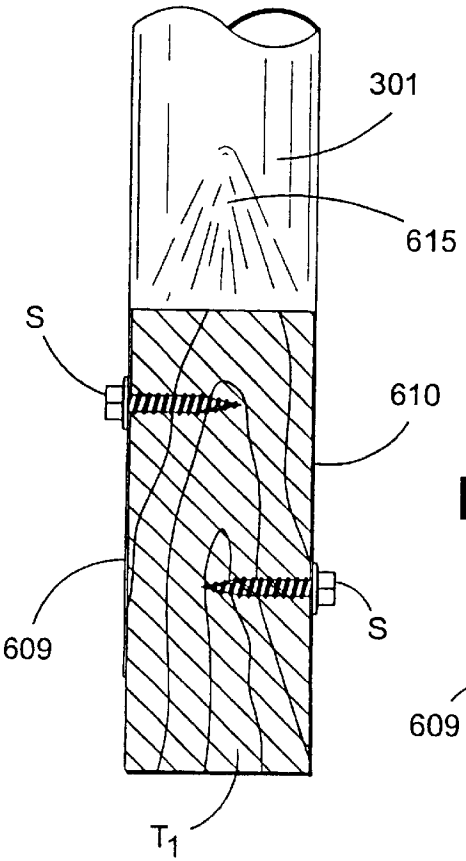
FIG. 31J shows the web of FIG. 31G applied to a chord of truss.

FIG. 31K shows the manner in which the web of FIGS. 31G to 31I is applied to a chord (for example the chord T1). The gussets 609 and 610 are applied over the chord T1 so that the gussets 609 and 610 sandwich the chord T1. The gussets 609 and 610 are each provided with at least one hole 616 and screws S are applied through the hole or holes 616 to join the gussets 609 and 610 to the chord T1.

Figure 32:
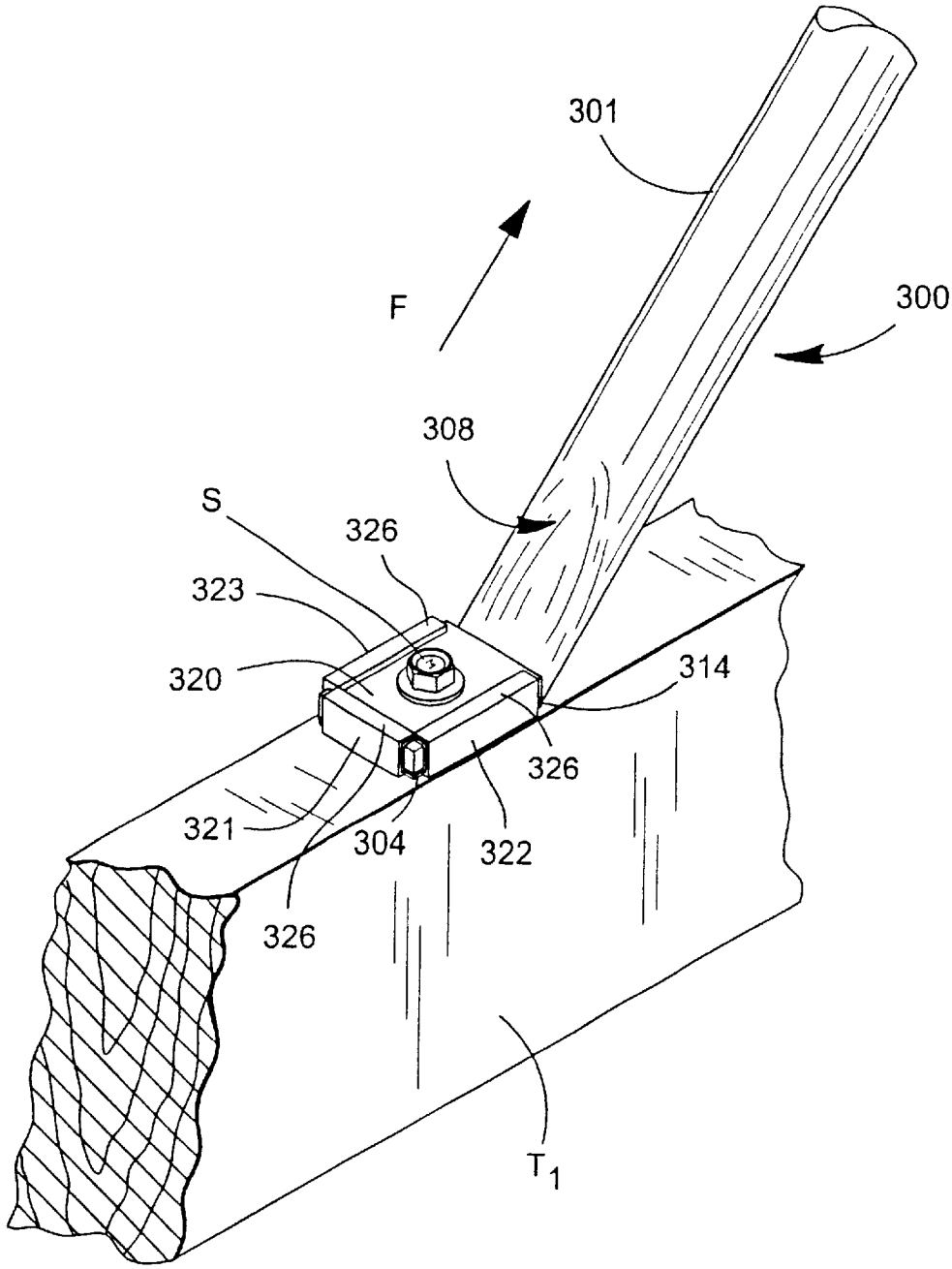
FIG. 32 is an enlarged, fragmentary view showing one preferred manner of connecting a metal web to a chord of a truss.

FIG. 32 shows one embodiment of how the tab portion 304 is attached to a chord T1. In this embodiment a washer 320 (substantially identical to washer 109, described above) of generally square or rectangular configuration is utilized and which sits on the tab portion 304. The tab portion 304 may have upstanding walls 321, 322 and 323 which form a housing in which the washer 320 locates. The walls 321 may have flanges 326 which are bent over after location of the washer. The walls 321, 322 and 323 prevent rotation of the washer 320 as the screw S is driven into the chord T1 to connect the web 300 to the chord T1. In other embodiments the tab 304 can be flat as described with reference to FIG. 23 and a separate box housing section (not shown) could be located beneath the tab portion 304 for receiving the washer 320 to hold the washer in place during driving of the screw S into the chord T1. In these embodiments the tab 304 or the separate box housing retains the washer in the required orientation shown in FIG. 32, that is with the washer parallel to the chord T1 so that it does not spin or project outwardly beyond the limits of the chord T1, thereby speeding up assembly of trusses according to this embodiment of the invention.

As is clearly shown in FIG. 32, the washer 320 is relatively thick and extends for substantially all of the length of the tab portion 304. Thus, the washer 320 extends from the hinge line 314 described with reference to FIG. 24 to the free end of the tab portion 304. The washer 320 provides additional strength to the connection of the web 300 to the truss T and also additional strength of the tab 302. If the web 300 is tensioned, that is force is applied in the direction of arrow F in FIG. 32, the washer 320 will resist the tendency to lift the tab portion 304 from the chord T1 at the position of the tab portion 304 which extends between the screw S and the hinge line 314 which defines the transition between the tab portion 304 and remainder of the web 300.

Figure 33:
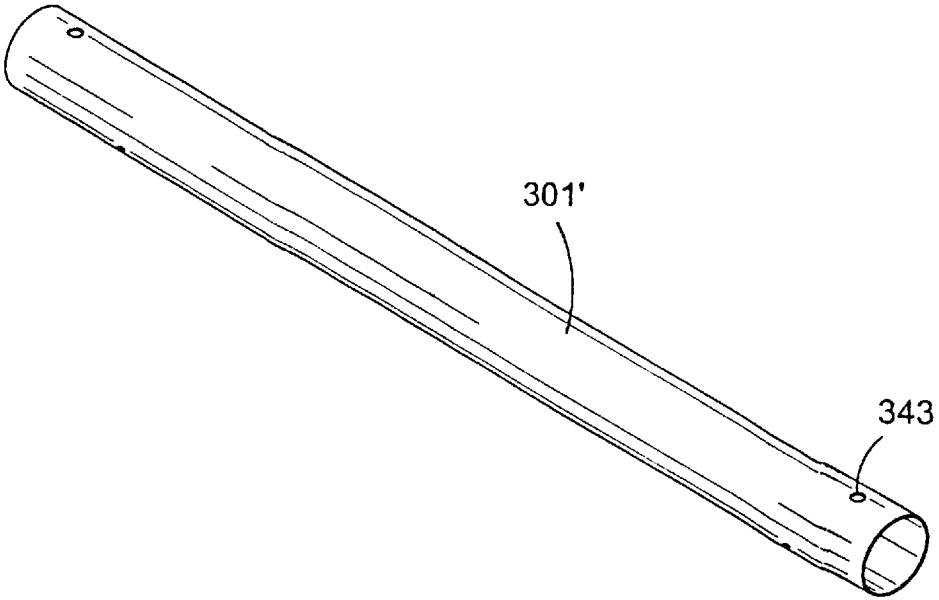
FIG. 33 is a perspective view of part of a metal web according to a further embodiment.
Figure 34:
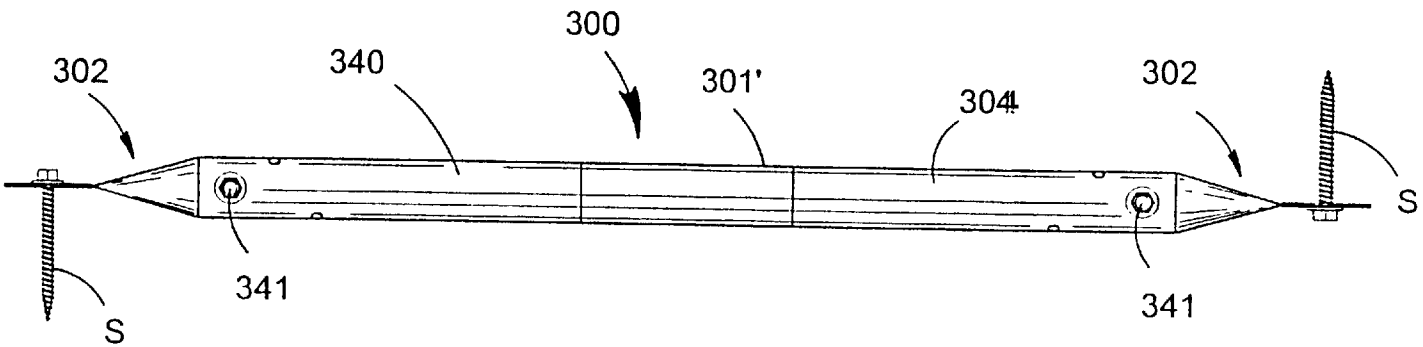
FIG. 34 is a side view of a completed metal web according to the embodiment of FIG. 33

FIGS. 33 and 34 shown an embodiment of the invention in which the web 300 is formed from a tube 301' as shown in FIG. 33. The ends of the tube 301' are not deformed to produce the tabs 302 previously described. Rather, in this embodiment, extension pieces 340 (see FIG. 34) are formed and have the tabs 302 formed at one end. The extension pieces 340 each include a sleeve into which a respective end of the tube 301' is inserted. The extension pieces 340 are fastened in place by a screw 341 which passes through a hole (not shown) in the extension piece and also a hole 343 in the tube 301'. In this embodiment a number of holes (not shown) may be provided along the length of the tube 301' so that the web 300 can be adjusted in length by securing the extension piece 340 to a desired one of the holes 343 or in a desired position along the row holes 343 to provide a web 300 of a desired length. This embodiment has the advantage of being easily able to adjust the length of the web 300 with the disadvantage that the web is formed from at least two different components thereby increasing the amount of stock required in order to form the web 300. Thus, this embodiment may reduce the number of stock lengths which must be retained in order to form building trusses at the expense of requiring additional components to form a completed web 300.

Figure 35:
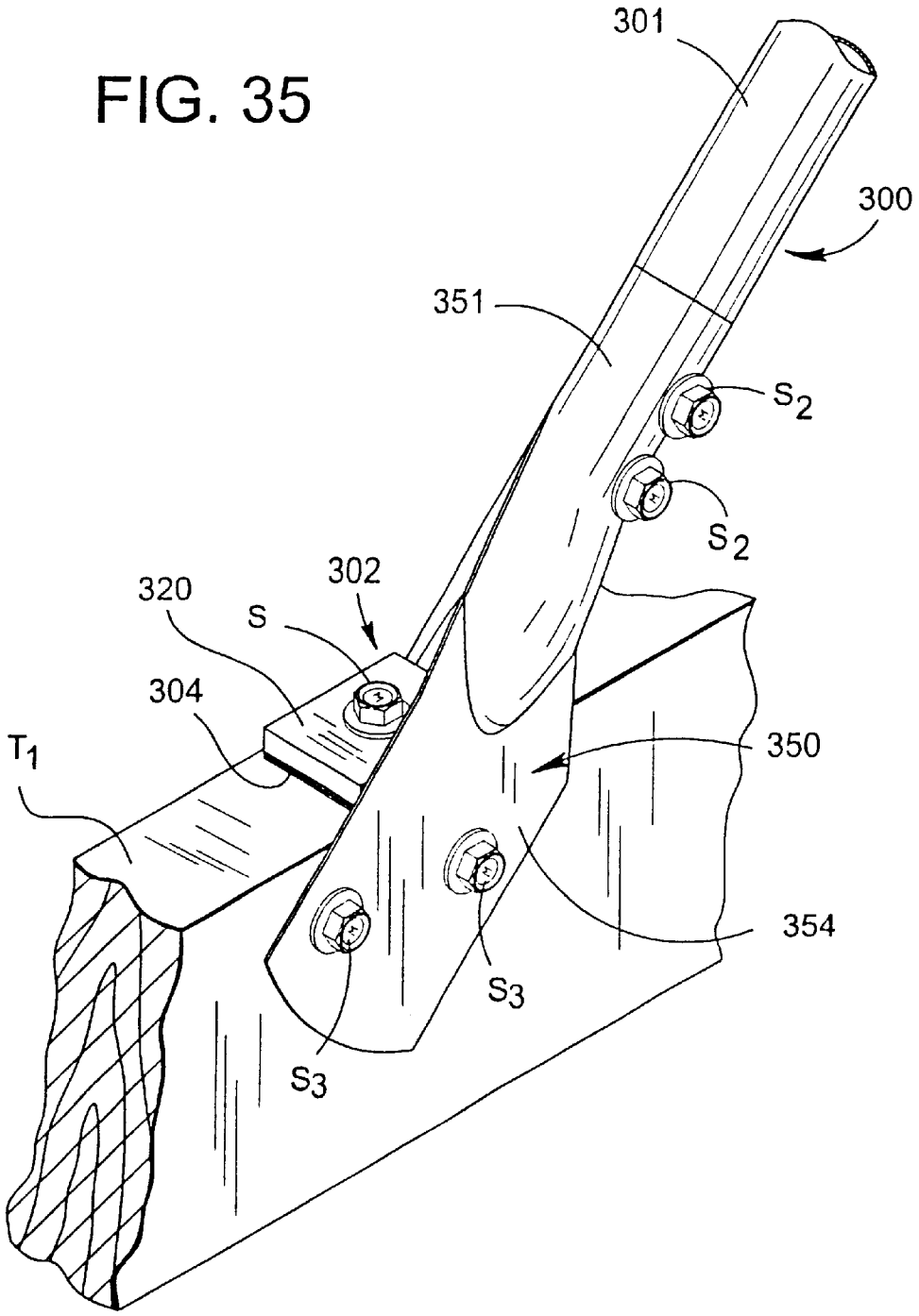
FIG. 35 shows a still further embodiment of the invention.

FIG. 35 shows a further embodiment in which the web 300 has an auxiliary connection member 350. The web 300 may be formed in the manner described with reference to FIGS. 23 to 26 with the securing tab 302 secured to chord T1 (for example) in the manner previously described. In this embodiment washer 320 is merely located on top of the tab portion 304 and the screw S secures both the washer 320 and 304 to the chord T1. The auxiliary connection portion 350 can serve either or both of the functions of, extending the length of the web 300 (in which case the tab portion 304 may not be secured to the chord T1) and providing additional strength of the connection of the web 300 to the chord T1.

The auxiliary connection portion 350 comprises a U-shaped section 351 which has holes (not shown). The section 351 may be semi-circular in cross section and formed from a part tubular member. The section 351 has a connection tab 354 formed at one end by flattening out the section 351, or alternatively, by merely forming the section 351 into the curved configuration from a blank whilst maintaining the portion 354 in the flat configuration.

The tube 301 of the web 300 is provided with a row of holes (not shown) and the section 351 is connected to the tube 301 by screws S2 which pass through the holes in section 351 and locate in holes (not shown) in the tube 301. The portion 354 has a pair of holes (not shown) which receive screws S3 to attach the auxiliary connection member 350 to the chord T1.

Thus, if additional connection strength of the web 300 to the chord T1 is required the web can be connected by the securing section 340 and the auxiliary connection member 350. If it is desired to increase the length of the web 300 then the connection member 350 can be coupled to the tube 301 at a desired position along the length of the tube 301. In that event, the web 300 would be connected to the chord T1 solely by the portion 354 and the screws S3.

Figure 36:
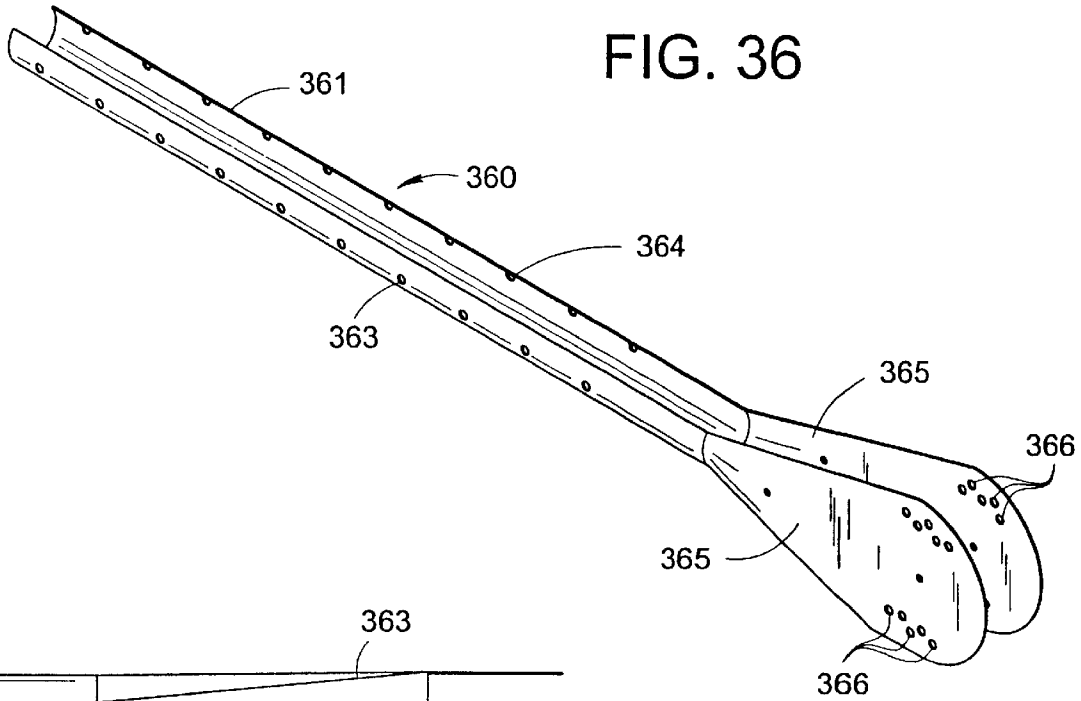
FIG. 36 is a perspective view of an extension and/or strengthen member used in one embodiment of the invention.
Figure 37:
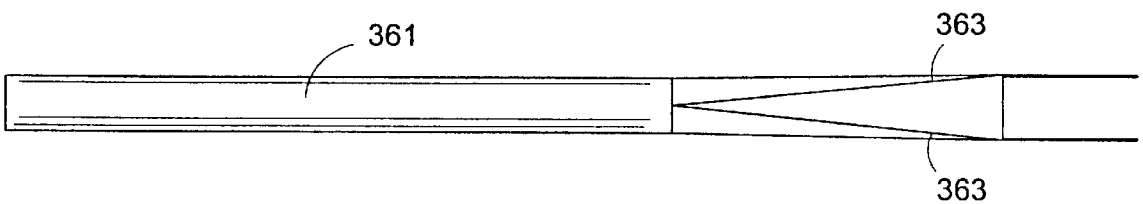
FIG. 37 is a bottom plan view of the member of FIG. 36.
Figure 38:
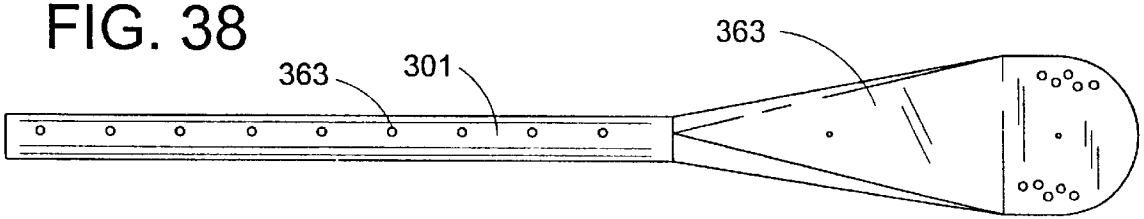
FIG. 38 is a side view of the member of FIG. 36.

FIGS. 36, 37 and 38 show a further embodiment of an extension member or strengthening member 360. In this embodiment the member 360 has a generally part tubular section 361 which has two opposed rows of holes 363 and 364 formed along its length. At one end of the section 361 a pair of connector paddles 365 are formed. The paddles 365 may be formed by forming a cut along part of the length of the section 361 and flattening out those parts of the section to form the paddles 365.

In this embodiment the remainder of the web 300 can be formed in the manner described with reference to FIGS. 23 to 26 or simply from a tubular member 301' as shown in FIG. 33. The member 360 can be secured to the tube 301 by sliding the tube into the U-shaped profile of the section 361 and adjusting the position of the section 361 relative to the tube 301 so that a desired one of the holes 363, 364 register with a hole at the end of the tube 301. A screw can then be inserted through the aligned holes to secure the member 360 to the tube 301. A member 360 can be attached to the other end of the tube 301 in the same manner if desired. The formed web 300 is then attached to a chord by locating the paddles 365 on opposed sides of the chord and hammering nails or driving a screw through holes 366 in the paddle members. This embodiment of the invention provides the ability to extend the length of a web 300 and also additional strength because of the two paddle sections 365 which attach to the chord.

Figure 39:
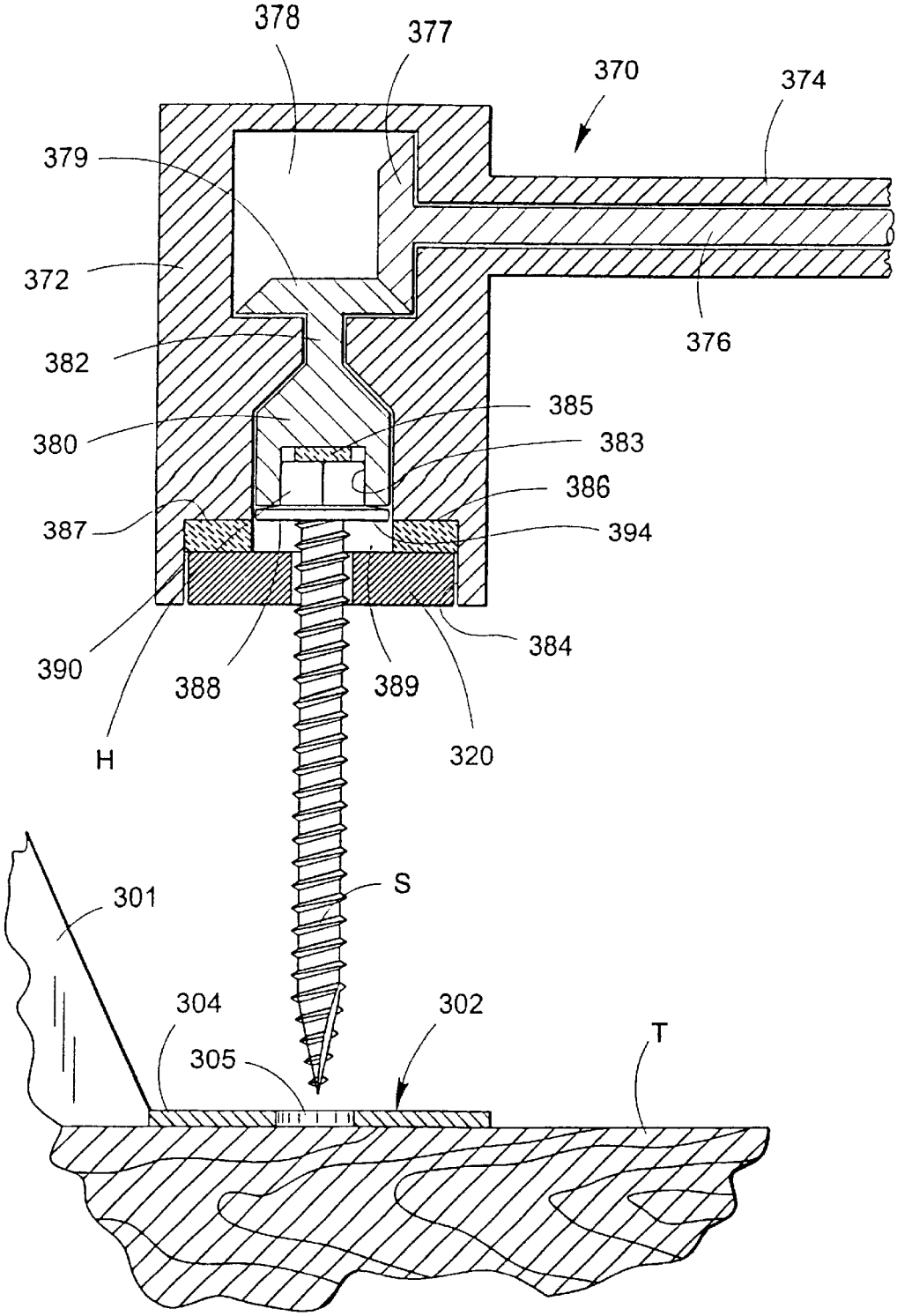
FIG. 39 is a schematic cross-sectional view of a driving tool used to fasten the metal webs according to the preferred embodiment to a chord of truss.

FIG. 39 shows a driving tool 370 for driving the screws S through the holes 305 in tabs portions 304 to connect the metal webs 300 to chords T1 to T3 of a building truss T. The tool 370 comprises a tool head 372 having a sleeve 374 which extends generally perpendicular to the axis of the screw S and the direction the screw S will be driven into the chords T. The sleeve 374 encloses a drive shaft 376. The drive shaft 376 may be connected to a motor (not shown) for rotating the shaft 376. The motor may be contained within a housing having a suitable hand grip section and actuation button for supplying power to the motor for rotating the shaft 376.

The shaft 376 has a bevel gear 377 attached to its end. The bevel gear 377 is contained within an upper cavity within the head 372. The bevel gear 377 meshes with a second bevel gear 379 also contained within the upper cavity. A socket 380 is received in a middle cavity and is a generally snug fit in the middle cavity but having sufficient tolerance to rotate within the cavity. The socket 380 has a neck portion 382 which is connected to the bevel gear 379. The bevel gear 379, neck 382 and socket 380 may be formed as an integral unit. The socket 380 has a socket recess 383 for receiving head H of the screw S. The socket recess 383 has a magnet 385 is adhered or otherwise attached to the closed end of the socket recess.

The cavity 379 is also in communication with a generally square shaped lower cavity. A magnet 386 is located in the lower cavity and is attached to top wall 387 of the cavity. The top wall 387 has an opening 388 which communicates the middle cavity with the lower cavity and generally allows the screw S to pass through the cavity so the head H can be received in the socket recess 383. The magnet 386 has a central opening 389 which registers with the opening 388 to also allow the screw S to be received in the socket recess 383.

Bottom surface 390 of the magnet 386 defines a surface against which washer 320 can sit. The screw S and washer 320 are formed from a ferromagnetic material and the magnet 385 serves to hold the head H of the screw S within the socket recess 382 so that the head is retained above the washer 320 within the socket recess 382. The magnet 386 holds the washer 320 within the recess 384. Thus, the screw S and the washer 320 can be applied to a hole 305 of a tab portion 304 to connect the tab portion 304 to a truss chord T1, T2 or T3 without the need of a workman to hold the screw S in place as the screw S is positioned and screwed down into the chord T.

The distance between a lower extremity 394 of the socket 380 and the bottom surface 390 is provided and dimensioned so as to prevent over tensioning of the screw S when the screw is driven into the chord T1. If the screw S is over driven when it is applied to the chord T1, T2 or T3 the over driving can strip out wood fibre from the chord and reduce the effective load on the connection screws. This can cause structural failure.

In the embodiments shown the bottom surface 390 of the magnet 385 spaces the washer 320 from the lower extremity 394 of the socket 380. However, if a greater space is required, or a smaller thickness magnet used, a spacer member (not shown) could be located against the lower surface 390 of the magnet 386 provided that the magnet is still able to provide sufficient magnet attraction to hold the washer 320 in the recess 384. The spacer would have a central hole similar to the magnet 386 to enable the screw S to pass into the socket recess 382.

Furthermore, it should be noted that the washer 320 is held in the required orientation in the square lower cavity so that when the tool is applied to the screw S the washer 320 is parallel with the chord T1 and does not project beyond the extremities of the chord T1. Thus, the washer 320 will be applied to the chord T1 in the required orientation (such as that disclosed with reference to FIG. 32) without the need for manual intervention, thereby speeding up assembly of trusses.

As will be explained in further detail hereinafter, the over tensioning of the screw S into the truss chord T1 is prevented because when the screw S is rotated by the socket 380 and driven into the chord T1, the screw S will eventually leave the socket recess 382 and the head H will locate in the space between the lower extremity of the socket 380 and the top of the washer 320. The space between the lower extremity and the top of the washer 320 may be dimensioned to completely accommodate the head H so that the head H leaves the socket recess 382 or, alternatively, the space may be slightly smaller than the height of the head H so that a small part of the head H still remains within the socket recess.

When the screw S is to be applied to a portion 304 the tool 370 is actuated so as to rotate the shaft 376 to rotate the socket 380. Rotation of the socket 380 will rotate the screw S. It should be understood that the washer 320 will remain in a fixed position within the recess 384 because of the square shape of the recess 384 and corresponding shape of the washer 320. Thus, the screw is screwed down or into a timber truss chord T1 due to rotation of the screw S. As the screw S is driven into the chord T1, the bottom surface of the washer 320 will eventually contact the surface of the chord T into which the screw S is being driven. When this occurs continued rotation of the screw S will cause the screw S to continue to be driven into the chord T with the head H beginning to leave the socket recess 382. When the head H abuts the top surface of the washer 320 the head H is accommodated within the space between the upper surface of the washer 320 and the lower extremity of the socket 380. If at this point the head H has completely left the socket recess 382 then obviously drive is no longer supplied to the screw S and therefore the screw S is not over driven into the chord T1. In other words, as soon as the head H screws down onto the top surface of the washer 320, the driving force or torque applied to the screw S is discontinued and therefore the screw is firmly screwed into the chord T1 but is not over driven into the chord T1.

If the space between the lower extremity of the socket 380 and the top of the washer 320 is such that the head H does not completely leave the socket recess 382, which is preferred, the head 382 will project only a very small distance into the recess 382 which is sufficient to provide driving torque to the screw S to continue driving of the screw S when the head H contacts the top surface of the washer 320. If any part of the head is retained in the washer 326 it will simply be slightly rounded off by rotation of the socket 380 because the engagement between the socket recess 382 and the head H is no longer sufficient to impart rotational torque to the screw S. The rounding off will not adversely effect the head H as it will be merely a slight rounding at the very uppermost portion of the head H. Thus, the integrity of the head H will remain in case it is necessary or desired to unscrew the screw S from the chord T1.

The right angled configuration of the drive shaft 376 with respect to the screw S and driving direction of the screw S is advantageous. This enables the head 372 to be positioned as close as possible to the transition between the portion 304 and the tube portion 301 of the web 300, while keeping the axis at rotation of the socket 380 perpendicular to the face of the chord T1 through which the screw will be driven. This, in turn, enables the hole 305 to be positioned as close as possible to the tube 301. Positioning of the hole 305 as close as possible to the tube 301 provides the advantage of reducing the bending moment which will be applied to the screw S during tension loading of the web 300. If the hole 305 is spaced a large distance from the tube 301 then the amount of leverage which will be applied to the screw S when tension is applied to the web 300 is greatly increased thereby increasing the possibility that the screw can be pulled out of the chord T1 by that applied tension force. The right angled configuration of the head 372 enables the head to be positioned close in against the tube 301 and yet perpendicular to the adjacent face of the chord, which may not be possible in all circumstances if the tool 370 had a drive shaft 376 are co-axial with the screw S. In such cases it may be necessary to position the screw S further from the tube 301, because of the confined space and interference with the tube 301 which may occur in some web configurations within a building truss thereby providing the disadvantages discussed above.

FIGS. 40 to 58 show a die tool for forming the tabs 302 on webs 300 in accordance with the preferred embodiment of FIGS. 23 to 26. The die tool comprises a bottom tool die 400 shown in FIG. 40 and top tool die 500 shown in FIG. 49. In use the top tool die 500 shown in FIG. 49 is inverted from the position shown in FIG. 49 and laid over the top of the bottom tool die 400 shown in FIG. 40 as will be shown in more detail with reference to FIGS. 54 to 58.

Figure 40:
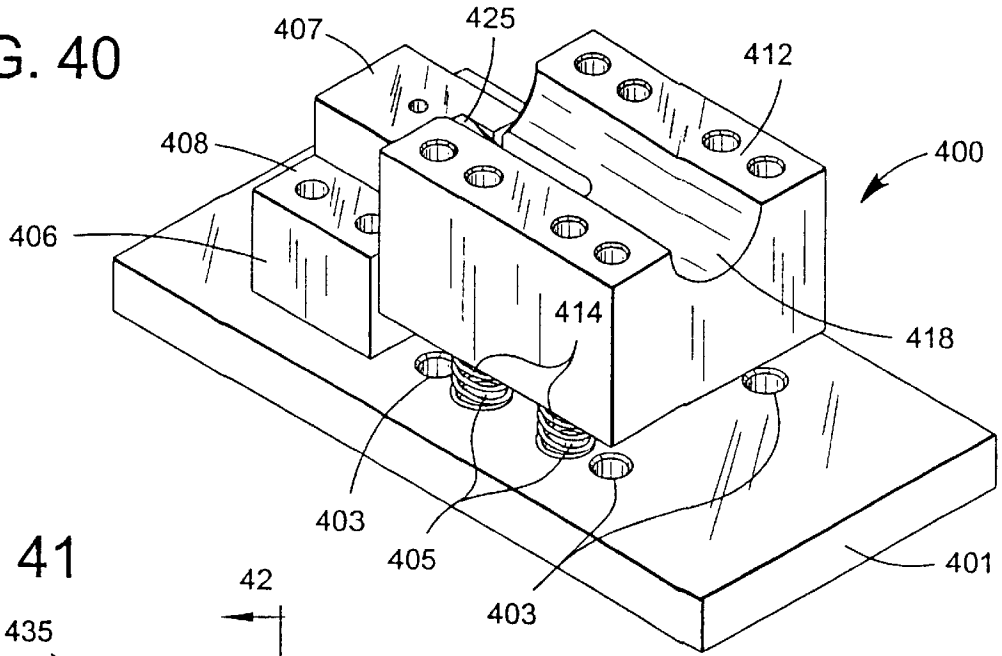
FIG. 40 is a view of a bottom die tool used in forming the metal webs according to FIGS. 23 to 26.
Figure 42:
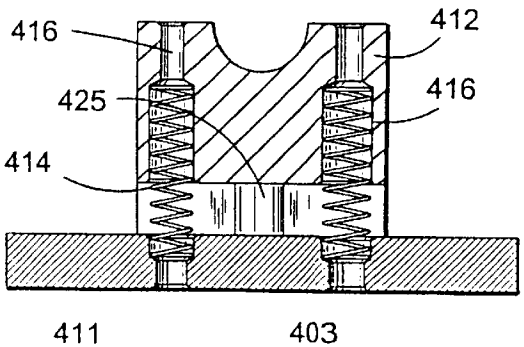
FIG. 42 is a cross-sectional view along the line 42—42 of FIG. 41.
Figure 41:
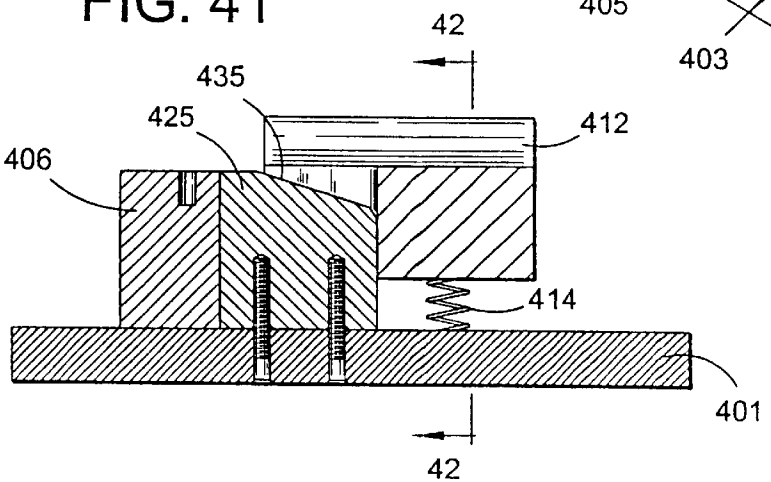
FIG. 41 is a cross-sectional view through the tool of FIG. 40.
Figure 46:
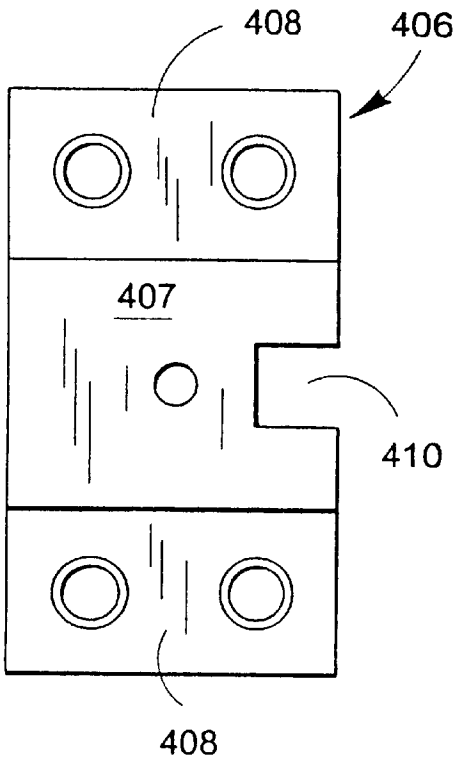
FIG. 46 is a plan view of the squash block of FIG. 45.
Figure 45:
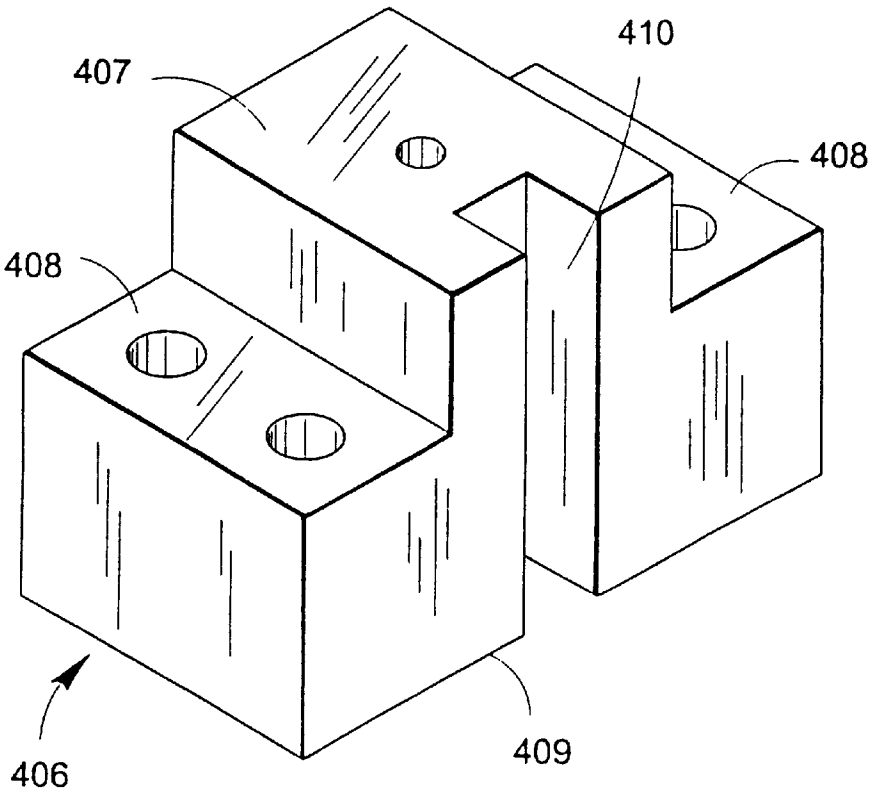
FIG. 45 is a perspective of a squash block used in the embodiment of FIG. 40.

With reference to FIGS. 40 to 42 die 400 comprises a base plate 401. The plate 401 has bores 403 for receiving pins (such as pins 411) which are used to locate components of the tool 400 and allow movement of the components relevant to one another as is usual in die tools. The base plate 401 also has bores 405. A squash block 406 (shown in more detail in FIGS. 45 and 46) is mounted on the base 401 and retained in place by pins (not shown) which locate in bores 403 and in corresponding bores in the block 406. The block 406 is fixed stationary relative to the base 401 and therefore the pins serve only to hold the block 406 in place and not allow movement of the block 406 relative to the base 401. As best shown in FIGS. 45 and 46 the squash block has a raised squash surface 407 and a pair of lower surfaces 408. A groove 410 is formed in the block 406 from the squash surface 407 down to base 409 of the block 406. Returning to FIGS. 40–42, a capture block 412 is mounted for relative movement to plate 401 by springs 414 which locate in the bores 405 and which extend into bores 416 in the capture block 412. The springs 414 bias the capture block 412 above the plate 401 as is best seen in FIG. 41.

Figure 44:
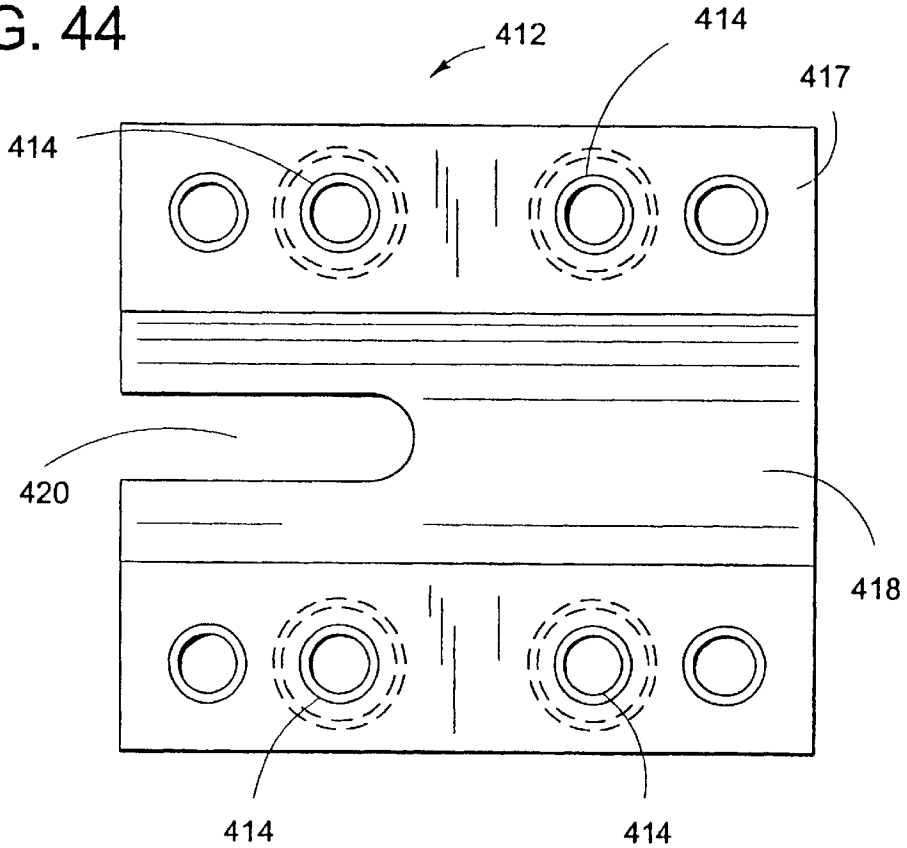
FIG. 44 is a plan view of the capture block of FIG. 43.
Figure 43:
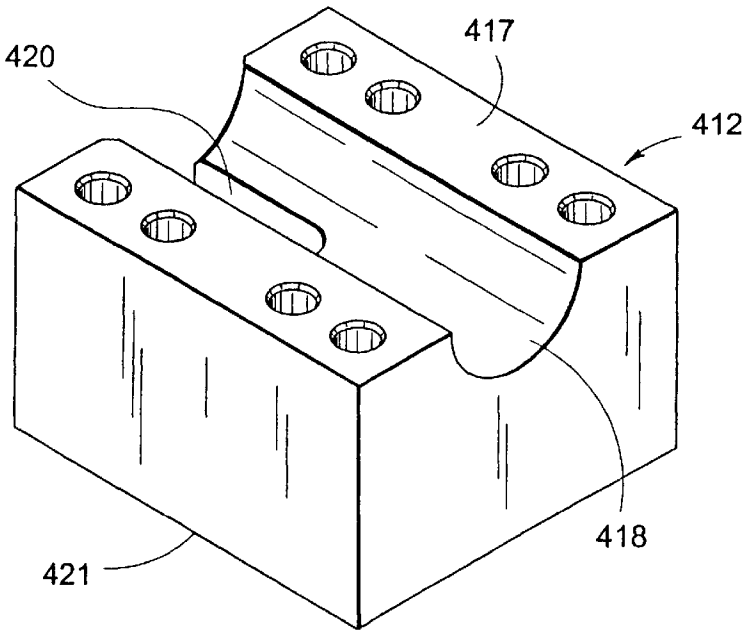
FIG. 43 is a perspective of a capture block used in the tool of FIG. 40.

As best shown in FIGS. 43 and 44 the capture block 412 has an upper surface 417 which is provided with a semi-cylindrical groove or channel 418 which matches the profile of the tube 301 from which the web 300 is to be formed. A groove 420 is formed in the capture block 412 and extends from the channel 418 to the base 421 of the capture block 412. When the capture block 412 is mounted on the base 401 as shown in FIGS. 40 to 42 the groove 420 registers with the groove 410 of the squash block 406.

Figure 47:
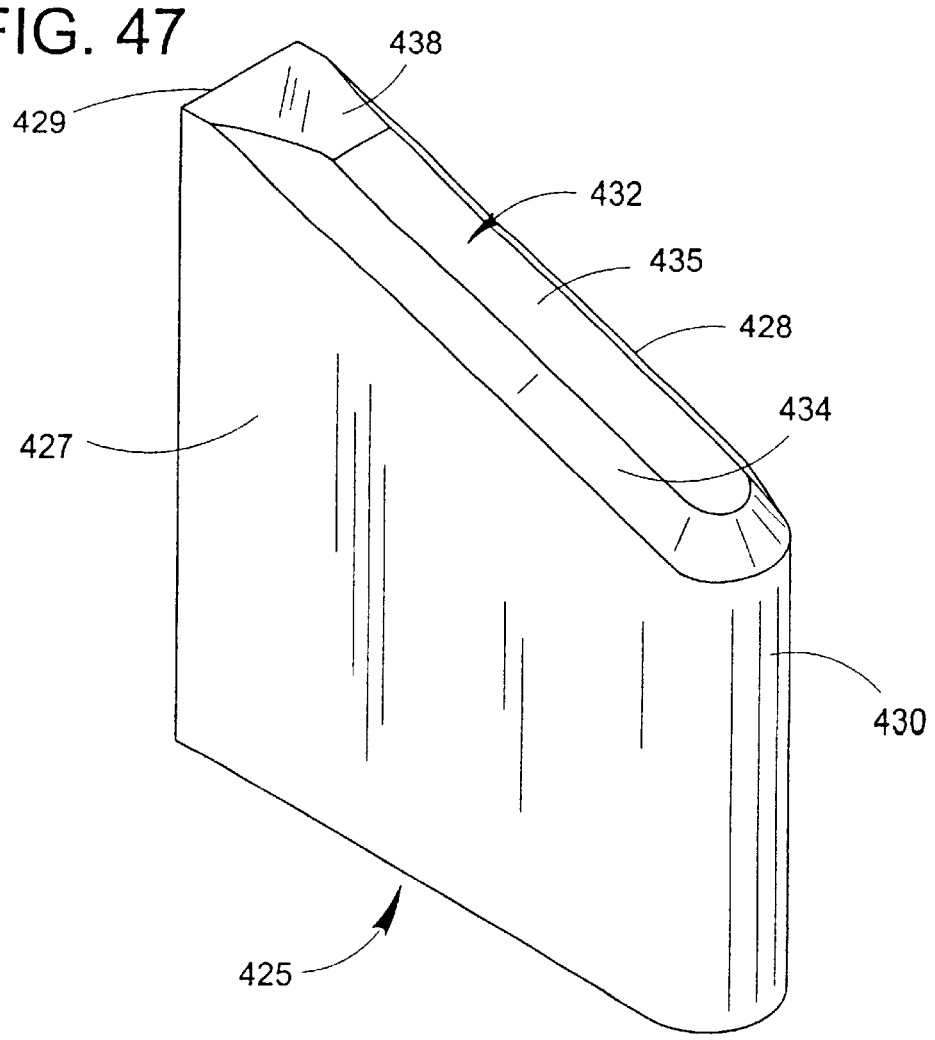
FIG. 47 is a perspective of groove block used in the tool of FIG. 40.
Figure 48:
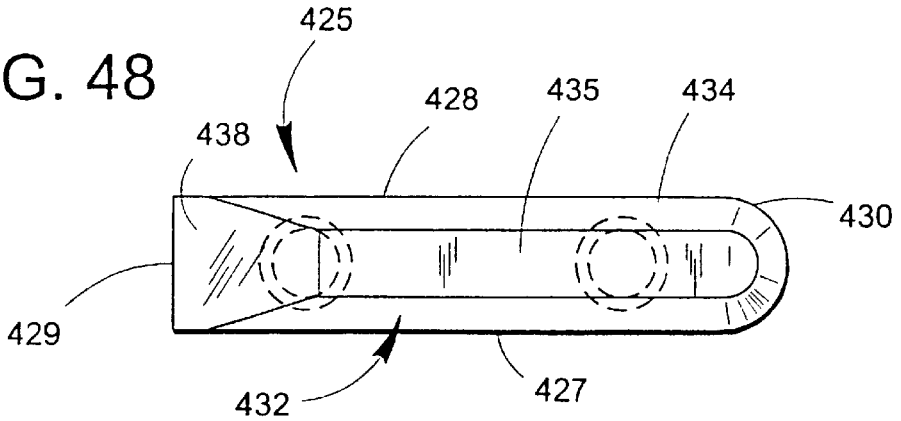
FIG. 48 is a plan view of the groove block of FIG. 47.
Figure 49:
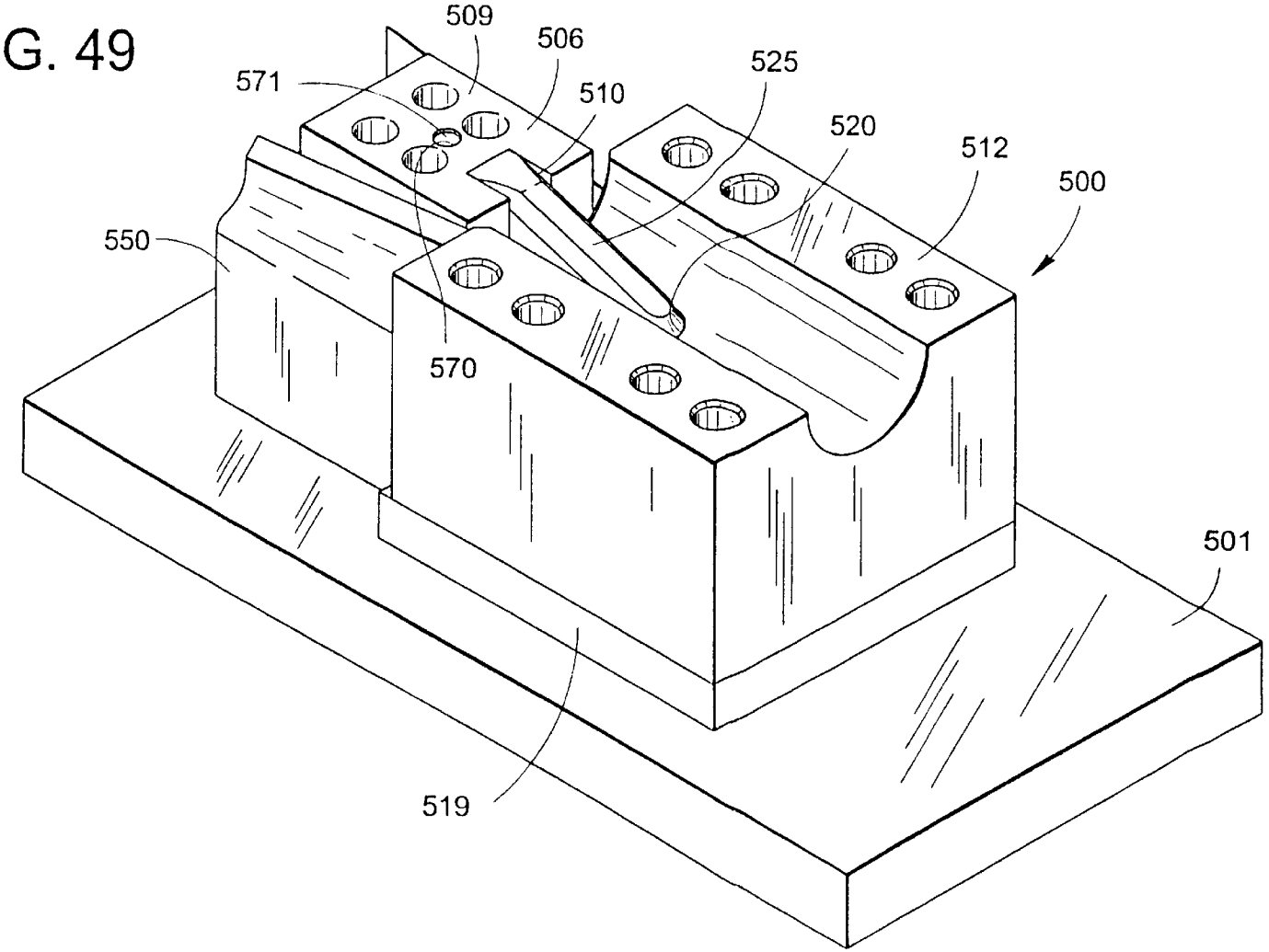
FIG. 49 is a perspective of a top die tool (shown in an inverted position to that in which it would be used) which is used with the tool of FIG. 40 to form a complete tool for forming metal webs according to FIGS. 23 to 26.

A groove block 425 which is best shown in FIGS. 47 and 48 is inserted into the grooves 410 and 420. The groove block 425 is of generally monolithic configuration having side walls 427 and 428. The side walls 427 and 428 are joined by an end wall 429 and a shorter rounded opposite end wall 430. An inclined valley forming surface 432 extends from the upper end of the wall 429 to the upper end of the wall 430. The configuration of the surface 432 is the reverse of the configuration of the valley 308 which is made in the tab 302 of the web 300 formed by the surface 432. The surface 432 has a generally U-shaped inclined wall portion 434 which will form the walls 312 and tension wall 312*a* of the valley 308, a flat surface 435 which will form the floor 307 of the valley 308 and a inclined end surface 438 which will form the surfaces 314 and entrance 304*a* of the valley 308. When the groove block 425 is located into the grooves 410 and 420, the wall 429 is located in the groove 410 and the opposite end wall 430 is received in the groove 420.

Figure 51:
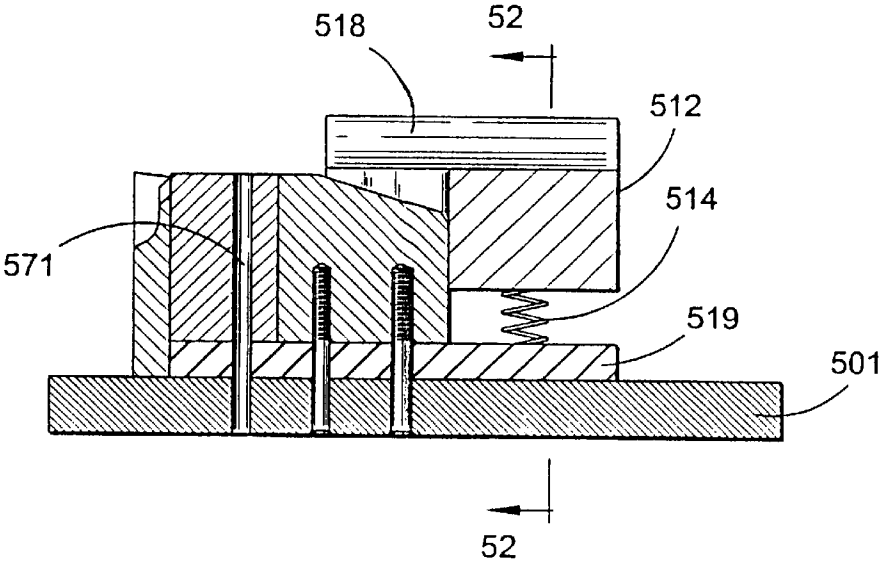
FIG. 51 is a cross-sectional view through the die of FIG. 50.

FIG. 49 shows the top die tool 500. The top die tool 500 is similar to the bottom die tool 400 in that it has a base plate 501, a squash block 506 and a capture block 512. The blocks 506 and 512 are configured the same as the blocks 406 and 412 previously described except that the block 506 has only a flat squashed surface 509. A groove block 525 of the same configuration as the groove block 425 is located in grooves 510 and 520 of the blocks 506 and 512 in the same manner as the block 425 is located in the blocks 406 20 and 412 of FIG. 40. The top die tool 500 is spaced from the base plate 501 by a compression block 519 of polyurethane or like material. The compression block 519 also extends beneath and supports the squash block 506 as can also be seen in FIG. 51. The block 512 is spaced from the plate 501 and the block 519 by springs 514 as best shown in FIG. 51. It should understood that the configuration shown in FIG. 49 shows the springs 514 completely compressed with the block 512 sitting on the compression block 519.

Figure 50:
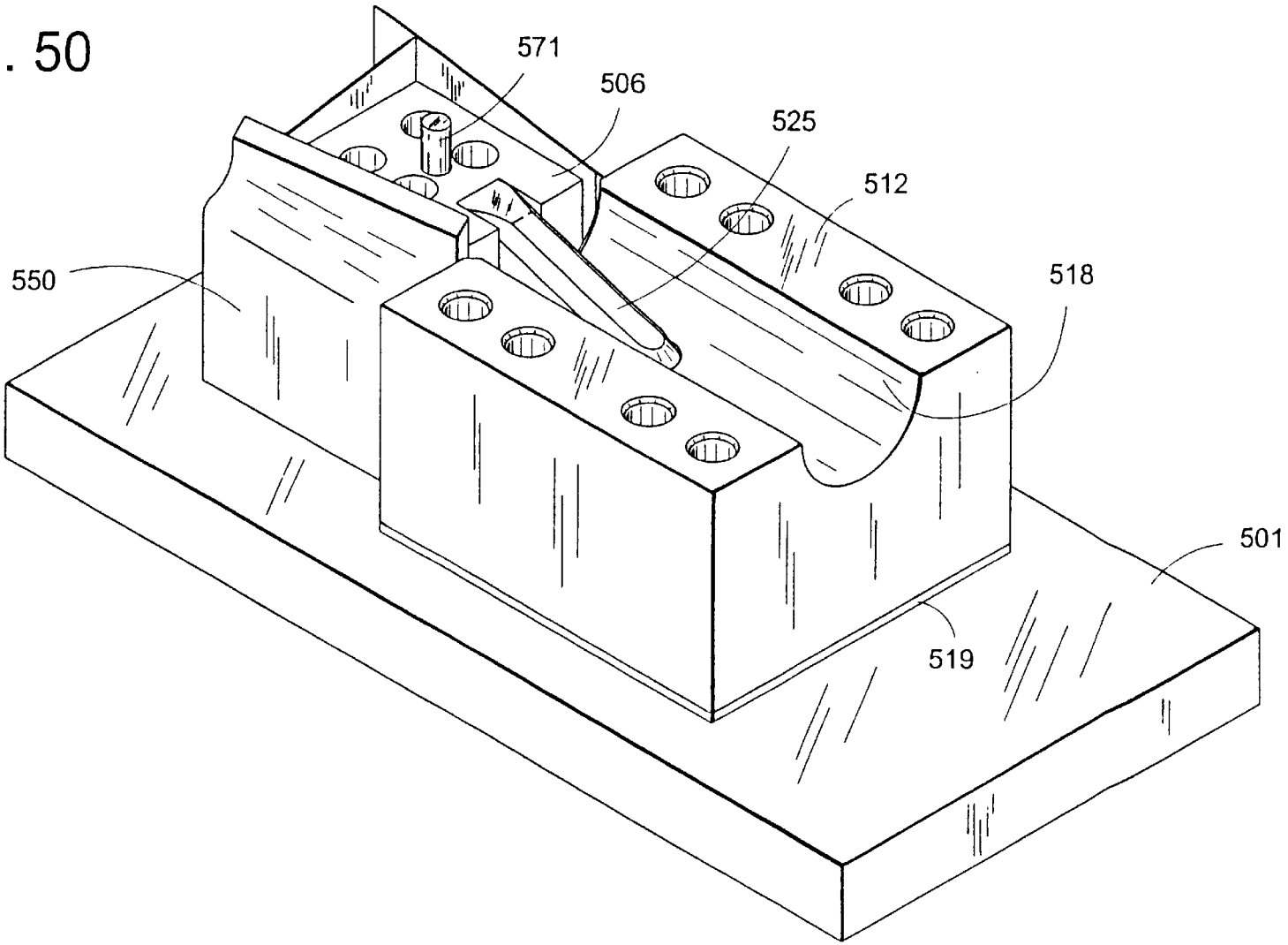
FIG. 50 is a view of the top die of FIG. 49 as shown in a compressed condition.
Figure 52:
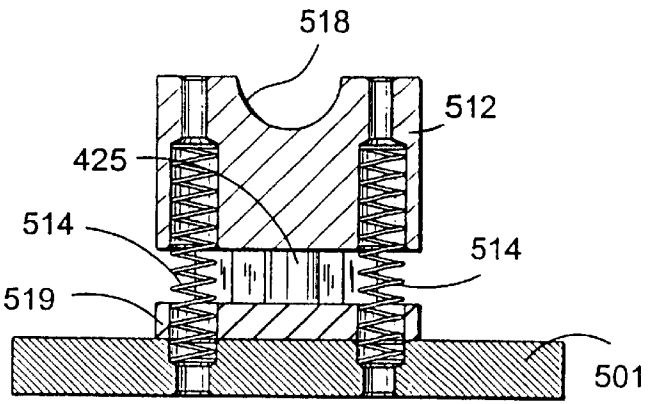
FIG. 52 is a cross-sectional view through the line 52—52 of FIG. 51.
Figure 53B:
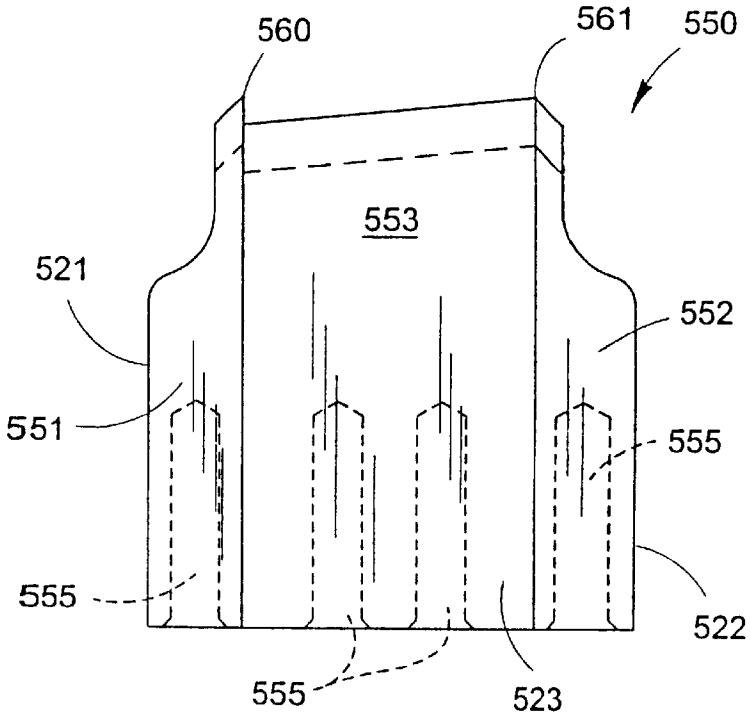
FIG. 53B is an end view of the guillotine tool of FIG. 53A.
Figure 53A:
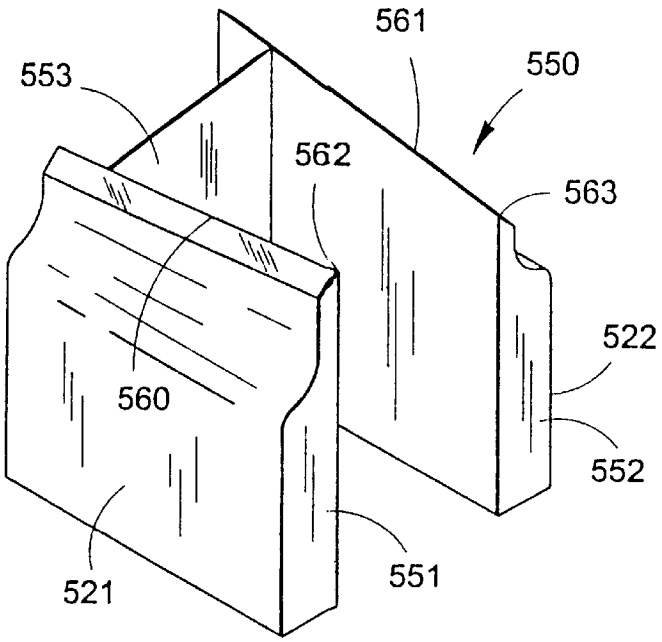
FIG. 53A is a perspective view of a guillotine tool used in the top die of FIG. 50.
Figure 53D:
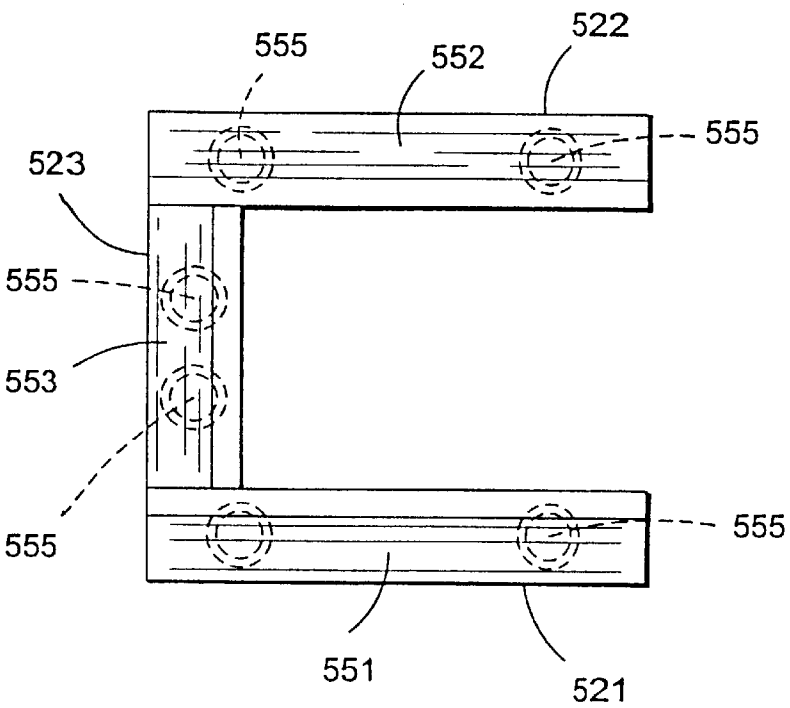
FIG. 53D is a plan view of the tool of FIG. 53A.
Figure 53C:
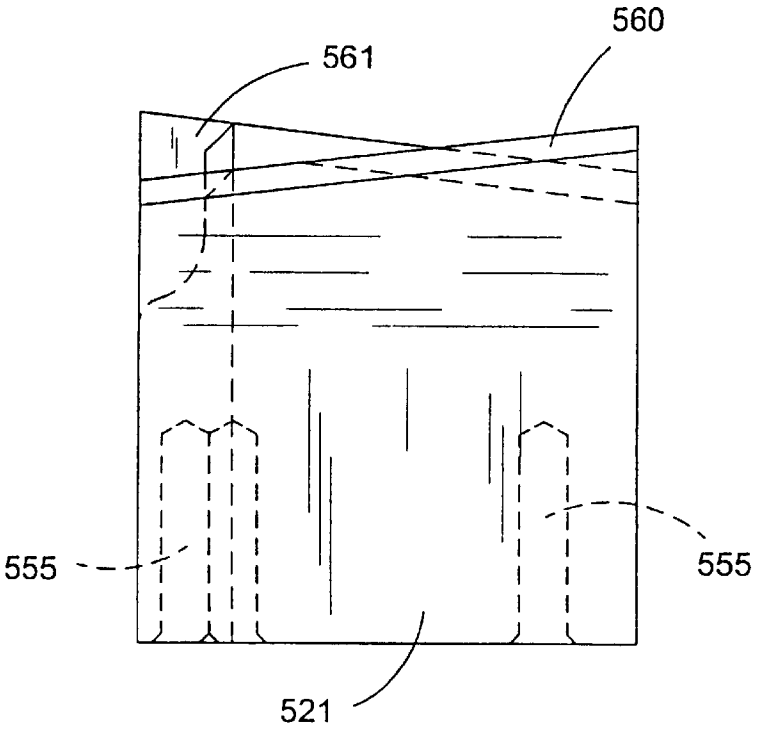
FIG. 53C is a side view of the guillotine tool of FIG. 53A.

A guillotine block 550 is fixed to the base plate 501 and surrounds the squash block 506. As best shown in FIGS. 53A, 53B, 53C and 53D the guillotine block includes side walls 521 and 522 and end wall 523. The walls 521, 522 and 523 generally form a U-shaped configuration as best shown in FIG. 53D so the guillotine 520 can be positioned about the squash block 506 as best shown in FIG. 49. The walls 521 and 522 carry knife edges 560 and 561 at their upper extremities. The knife edges 560 and 561 are inclined with the knife edge 560 inclined upwardly from wall 523 to end 562 and the knife edge 561 inclined downwardly from wall 523 to end 563. The walls 521 include bores 555 for receiving pins (not shown) to secure the guillotine block 520 to the base plate 501. Once again, the guillotine block 520 is positioned in place without the need for movement relative to the plate 501. As shown in FIG. 49 the squash block 506 has a central bore 570 which locates a tubular punch 571. When the squash block 506 and capture block 512 are in their starting positions where they are biased away from base plate 501 by the springs 514, the punch 571 is retained within the bore 570. When the blocks 506 and 512 are in their fully compressed condition, when not only the springs 514 are fully compressed but the compression block 519 is also fully compressed, the punch 571 projects out of the block 506 as can be seen in FIG. 50.

Figure 54:
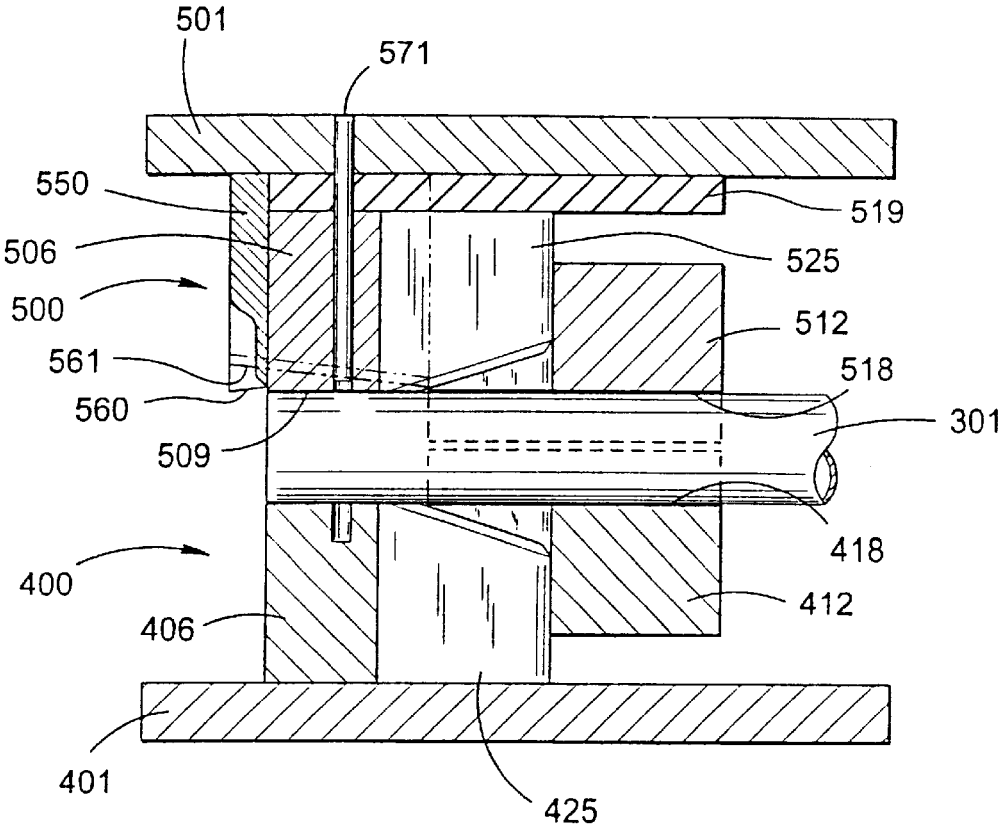
FIG. 54 is a view showing the commencement of the formation of a metal web of the type shown in FIGS. 23 to 26, using the tool formed from the die tools of FIG. 40 and FIG. 50.

The sequence of operations for forming the tabs 302 of the webs 300 shown in FIGS. 23 to 26, will be described with reference to FIGS. 54 to 58. In order to configure the tool shown in FIGS. 40 to 53, the top die tool 500 is inverted from the position in FIGS. 49 and 50 and arranged above the tool 400 as shown in FIG. 54. The plates 401 and 501 are connected to a press machine (not shown in the drawings).

Figure 54A:
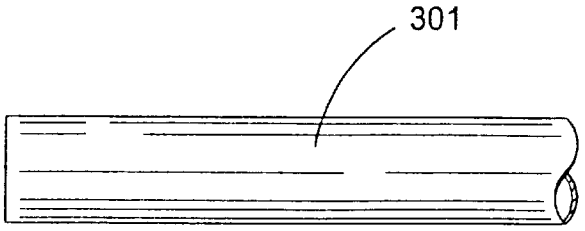
FIG. 54A is a fragmentary elevation of the metal web in initial condition before formation from the tool as shown by FIG. 54.

As shown in FIG. 54, the unformed tube 301 (FIG. 54A) which is to be used to form the web 300 is inserted into the cylindrical cavity defined by the two grooves 418 and 518 in the capture blocks 412 and 512. In the position in FIG. 54 the blocks 512 and 412 are biased away from their respective plates 501 and 401 by springs 514 and 414 (which are not shown in FIG. 54 for ease of illustration). In this configuration the groove blocks 425 and 525 are retained fully within the grooves 410, 420 and 510, 520 respectively. Similarly, the knife edges 560 and 561 of the guillotine 520 are retracted from (that is above in FIG. 54) the squash surface 509 of the squash block 506. FIG. 54A shows the tube 301 in this position where the tube 301 has not yet been acted upon and is in its original condition.

Figure 55:
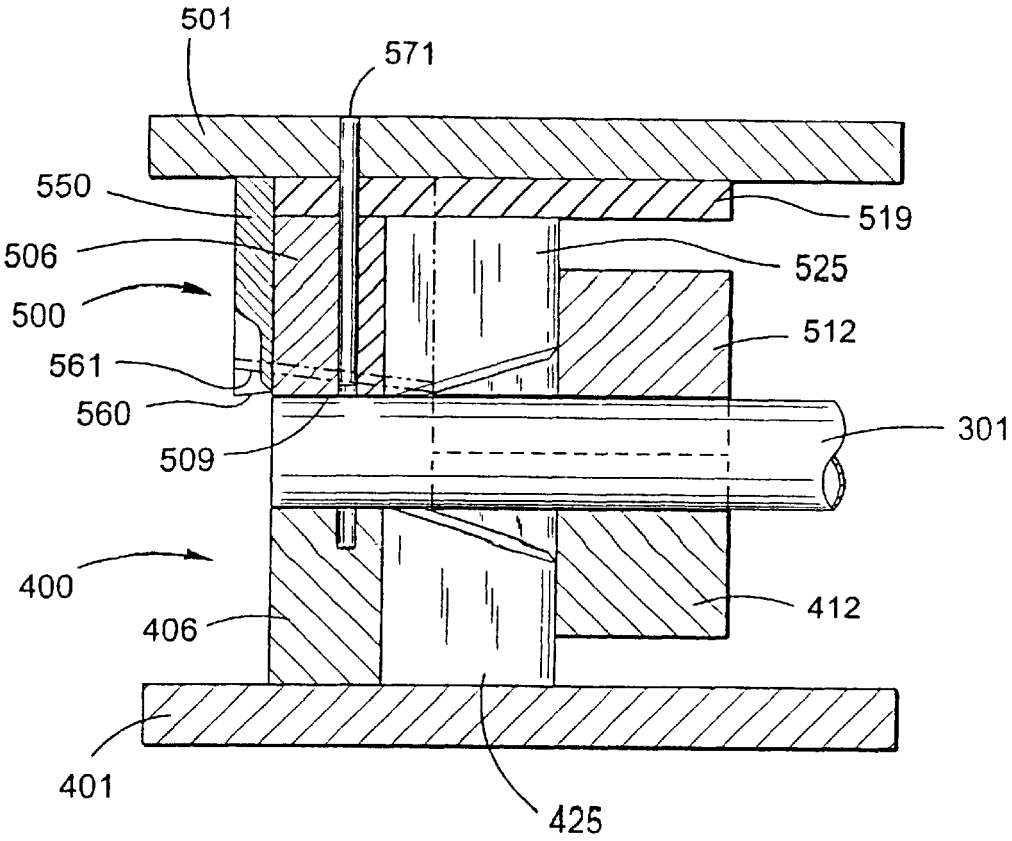
FIGS. 55 and 55A, FIGS. 56 and 56A, FIGS. 57, 57A and 57B and FIGS. 58 and 58A schematically show a sequence of operations of the tool of FIGS. 40 and 50, and the web as it is being formed during those sequence of steps.
Figure 55A:
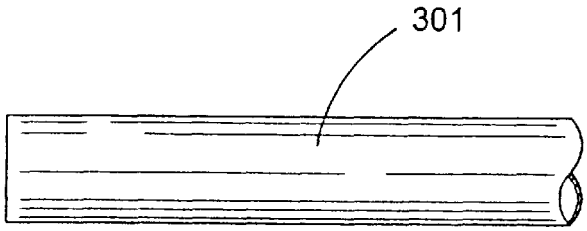
Figure 56:
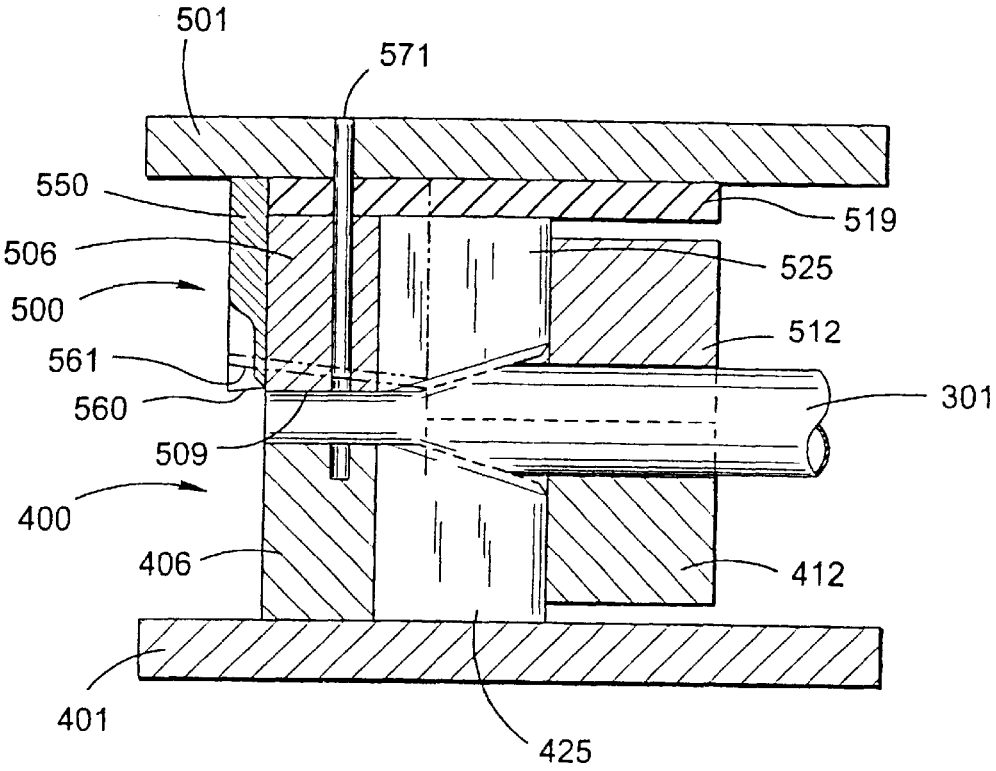
Figure 56A:
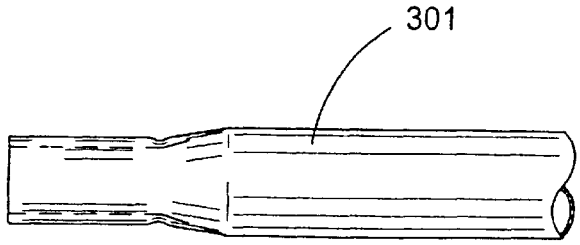

FIG. 55 shows first movement of the plates 501 and 401 towards one another under the influence of the pressing machine (not shown) so as to capture the tube 301 (FIG. 55A). In this position the tube 301 is still not acted on but is merely captured and tightly held within the cylindrical space defined by the grooves 518 and 418. Continued movement of the pressing machine will cause the springs 514 and 414 to begin to compress allowing the capture blocks 412 and 512 to move towards their respective base plates 401, 501. This movement moves the capture blocks 412 and 512 relative to their respective groove blocks 425 and 525 so the groove blocks now begin to project into the cylindrical space defined by the channels 418 and 518 through the grooves 420 and 520 and work on the tube 301. Simultaneously, the squash blocks 406 and 506 also begin to project beyond the capture block and begin to squash the end of the tube 301. As shown in FIGS. 56 and 56A this begins to form the end of the tube 301 to commence formation of the tab 302. The squash blocks 406 and 506 are beginning to squash the end of the tube 301 to form the tab portion 304 of the tab 302 and the groove blocks 525 and 425 are beginning to form the valley 508 and ridges 509 of the tab 302. It will be understood at this stage of operation the guillotine knife blades 560 and 561 are still retracted behind the surface 509 of the squash block 506.

Figure 57:
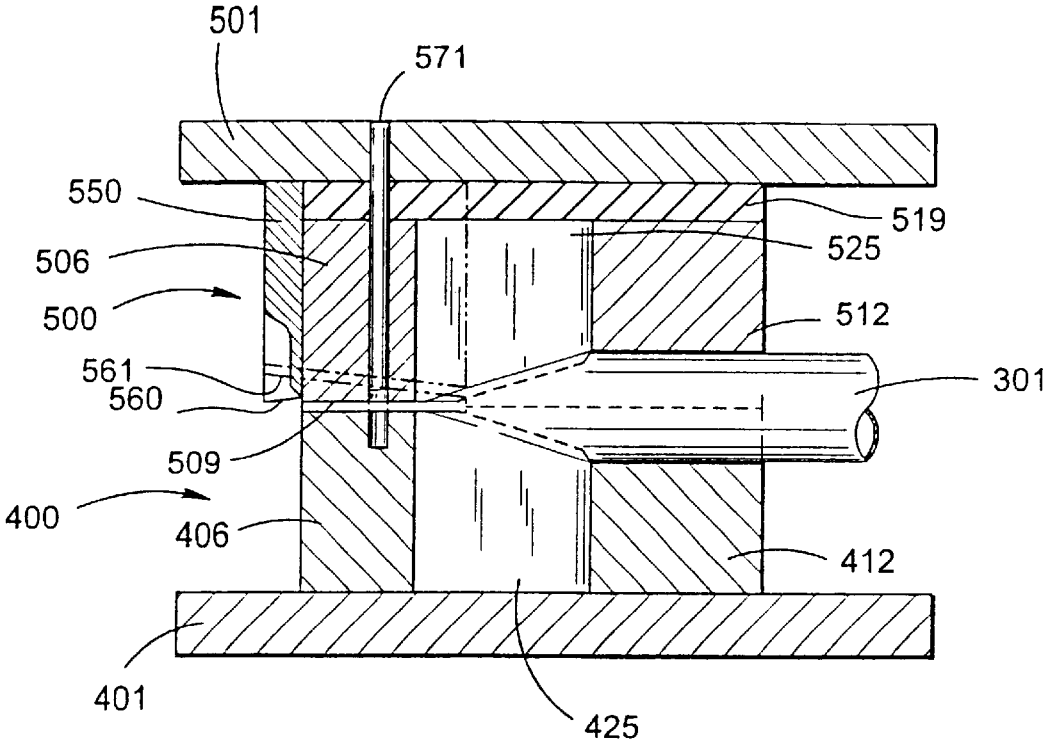
Figure 57A:
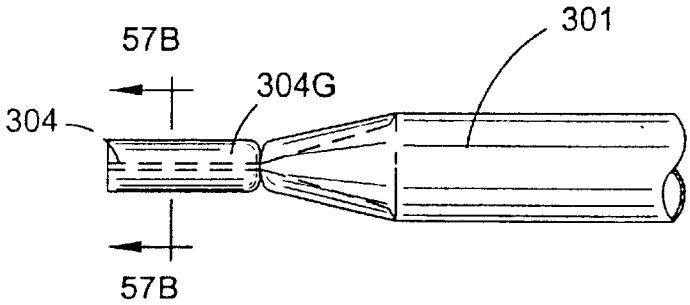
Figure 57B:
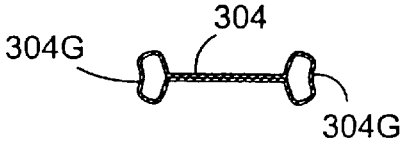

Continued movement of the press machine brings the base plate 401 against the bottom of the capture block 412 so that springs 414 are fully compressed. Similarly, the capture block 512 is now resting on the compression block 519. This movement has brought the squash surfaces 509 and 407 of the blocks 506 and 406 fully together to squash the end of the tube 301 to form the tab portion 304 of the tab 302. In this position the guillotine blades 560 and 561 as well as the punch 571, are still retained behind the surface 509 of the squash block 506. It will be apparent from the consideration of FIGS. 57A and 57B that in the squashing of the end portion of the tube 301 to form the tab portion 304, bulges 304*g* are formed at the side edges of the flat tab portion 304. As will also be apparent from the consideration of FIGS. 57 and 57A, the groove blocks 425 and 525 now project into the cylindrical space formed by the grooves 420 and 520 to their maximum extent thereby fully forming the valley 308 and ridges 309 of the tab 302.

Figure 58:
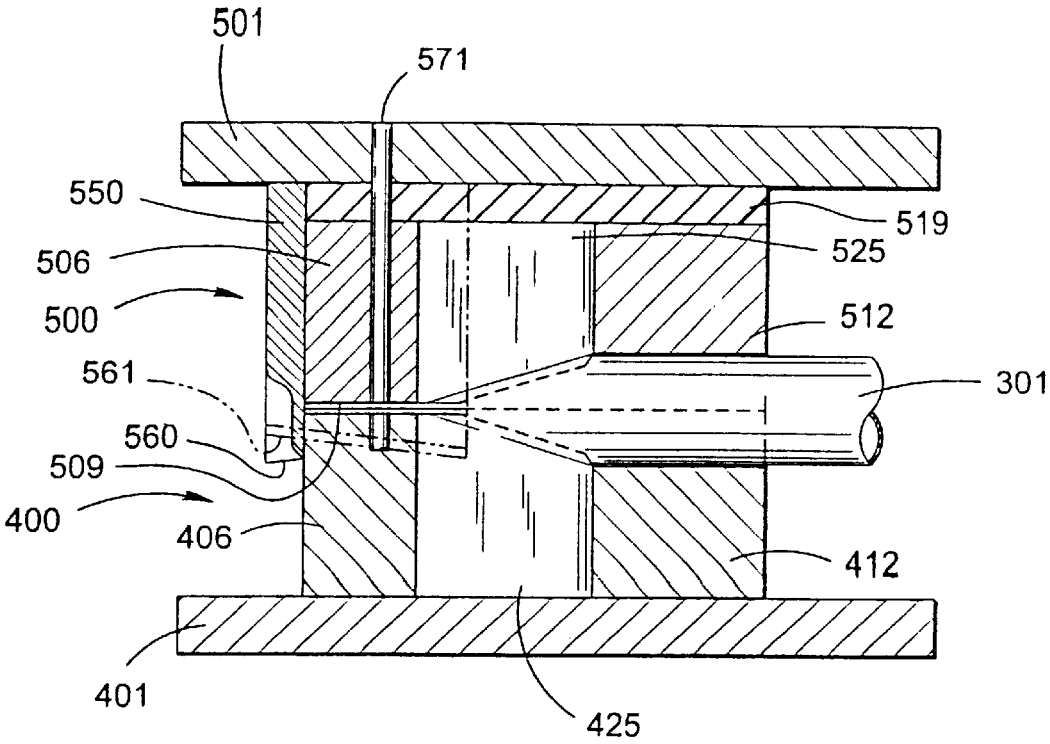
Figure 58A:
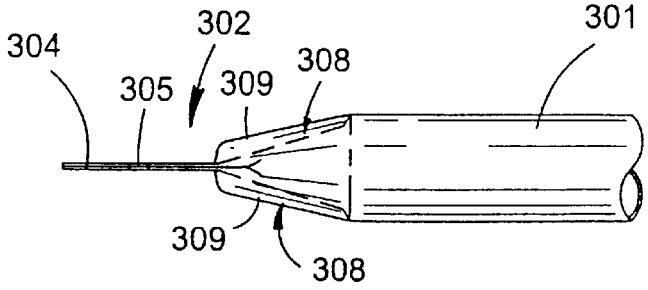

As shown in FIG. 58, continued movement of the press machine will begin to move the base plate 501 relative to the capture block 512 and squash block 506 by compressing the compression block 519. As the compression block 519 is compressed, the guillotine 550 and the punch 571 are moved relative to the squash block 506 so that the knife edges 560 and 561 are brought down to bear on the flat securing section 304 of the tab 302 adjacent the bulges 304*g* thereby slicing the bulges 304*g* from the flat tab portion 304 to only leave the flat securing section 304 as shown in FIG. 58A Simultaneously, the punch 571 punches the hole 305 through the tab portion 304 as it is driven out of bore 570 in the squash block 506. It should be understood that the step or space provided between the squash surface 407 of the block 406 and the surfaces 408 provide room for movement of the knife blades 560 and 561 of the guillotine 520 and also a accommodate the bulges 304*g* which are formed during flattening of the tube 301 by the squash surfaces 407 and 509. The press machine can then be released to retract the plates 501 and 401 away from one another so that the formed web 300 can be removed.

As will be apparent from the above description of the manner in which the securing tab according to the embodiment of FIGS. 23 to 26 is formed, the formation of the valley of the valley 308 by the groove blocks 425 and 525 has the effect of pushing material down towards the center of the tube thereby preventing outward expansion of the tube at this part of the web during flattening to form the tab portion 304. Slicing of the bulbous or lateral edge portions 304*g* from the edges of the flattened portion 304 has the effect of ensuring this part of the formed securing tab does not extend beyond the periphery of the tube 301 of the web 300. Further still, removal of the bulges 304*g* takes away a considerable amount of material from the side edges of the tab portion 304 and therefore makes it easy to bend the tab portion to the required position so that the tab portion can rest flat against the required surface of a chord as described with reference to FIGS. 27 to 30. If the bulges 304*g* are left in place not only will this mean that the securing tabs would extend beyond the periphery of the tube 301 but also a substantial mass of material is left which would make it very difficult, if not impossible, to bend the flattened tab portions 304 to the required angle so that they can sit flush against the chords of a truss during assembly of a truss.

In the preferred embodiment of the invention the tab portion 304 is bent during assembly of the truss without the need for any tool. The tab portion 304 can be bent by pushing an end of the tab portion 304 against the chord and then applying a force to the web 300 so as to cause the tab portion 304 to bend. Alternatively, the tab portion 304 can be bent by application of the screw S through the tab and into the chord so that as the screw S is driven into the chord the screw S contacts the tab portion to bend the tab portion into the desired configuration. If desired, the tab portion 304 can be provided with a slight bend to facilitate the further bending of the tab portion either by application of the screw or by force applied to the web 300 and engagement of the tab portion with the chord.

Thus, according to the preferred embodiment of the invention no tool at all is required in order to bend the tab portion 304 thereby simplifying assembly and reducing the cost of assembly because of the need not to provide any particular tool to bend the tab portion. In practice, a single pressing machine may carry a number of die tools of the type described with reference to FIGS. 40 to 58 so that a number of webs 300 are formed in a single operation. Furthermore, both ends of the web 300 can be formed within the press machine or in separate press machines simultaneously so as to form the entire web 300 in a single operating sequence.

Figure 59:
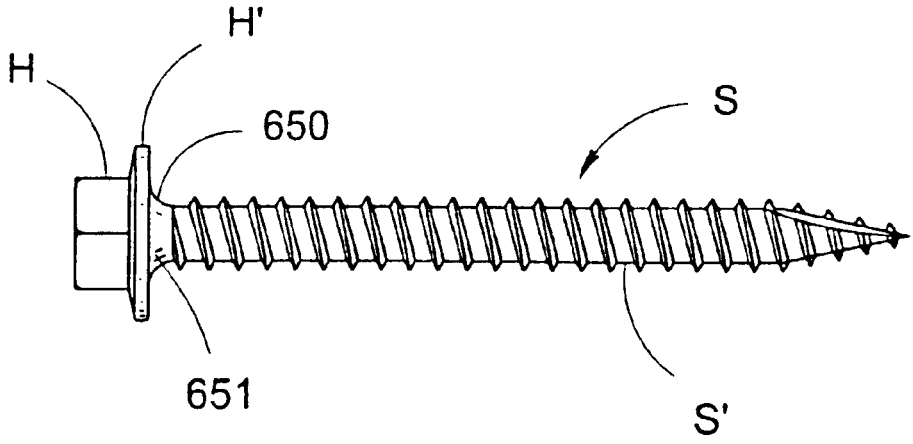
FIG. 59 is a view of a screw used in the preferred embodiment.

FIG. 59 shows the preferred structure of a screw S used in the embodiments previously described. The screw S has a head H including an integral flange or washer portion H' and a shank S' which is screw threaded in a conventional manner. The shank S' and its screw threading is of the conventional self tapping style. The shank S' joins with the flange H' of the head H by a transition section 650 which tapers outwardly so as to form a region of increased thickness 651 between the shank S' and the washer portion H' of the head H. This increases strength of the transition between the head H and shank S, preventing breaking of the head H from the shank S' when load is applied to the screw S. In conventional screws the shank S joins with the head H at a generally right angle step transition with no variation in thickness that the transition between the shank S and the head H. Thus, the head H is susceptible to breakage under load.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A metal web member for use in a fabricated framework comprising at least two spaced apart beams with transverse thickness and having exterior surfaces and at least one web member secured to the beams and extending between exterior surfaces of the beams, said web member comprising:

a support section having transverse width substantially equal to or less than the transverse thickness of the beams and having opposite ends;

a tab extending longitudinally from the support section at each end thereof and having planar engagement surfaces, each tab being sized and shaped for generally flat, face-to-face engagement of its planar engagement surface with a respective one of the exterior surfaces of one of the beams for securement of the tab thereto, said tab having transverse width substantially equal to or less than the transverse width of the support section, said tab being further adapted to receive a fastener through the planar engagement surface for the securement of the web member to the beams; and a transition section which merges the tab with the support section of the web member, the transition section having a pair of ridges on each side of the web member defining respective valleys, each ridge angling laterally outwardly from a position adjacent the support section to a position adjacent the tab.

2. A web member as set forth in claim 1 wherein each tab has a preformed hole therein for receiving the fastener therethrough.

3. A web member as set forth in claim 1 wherein at least one of the tabs extends at an angle to a longitudinal axis of the support section.

4. A web member as set forth in claim 1 wherein the tabs are constructed for manual bending relative to the support section for placement of tabs at opposite ends of the support section in flat, face-to-face engagement with respective exterior surfaces of the beams.

5. A web member as set forth in claim 4 wherein each tab includes a weakened region to facilitate manual bending.

6. A web member as set forth in claim 5 wherein the support section and tabs are formed entirely of a tube and the tabs are defined by flattened ends of the tube, and wherein the weakened regions comprise cuts through the tube along generally transverse edges thereof.

7. A web member as set forth in claim 1 wherein the support section and tabs are formed entirely of a tube and the tabs are defined by flattened ends of the tube, the tabs being cut in the longitudinal direction of the web member after the ends of the tube have been flattened so the transverse dimension of the tab is substantially equal to or less than the transverse width of the support section.

8. A web member as set forth in claim 1 wherein the support section and tabs are formed entirely of a tube and the tabs are defined by flattened ends of the tube, the support section including a deformation adjacent the tab created during formation of the tab for restricting the transverse dimension of the tab to less than the transverse dimension of the support section.

9. A web member as set forth in claim 8 further comprising an extension piece for adjusting a length of the web member, wherein the tab is formed integrally with the extension piece and the support section is free of tabs formed integrally therewith.

10. A web member as set forth in claim 1 adapted to be selectively adjusted in length.

11. A web member as set forth in claim 1 further comprising a washer engageable with the tab and the fastener passing through the tab for reinforcing the tab, the tab including upstanding side walls arranged for receiving and orienting the washer on the tab.

12. A web member as set forth in claim 1 wherein the tab includes first and second tab portions, the first tab portion being arranged generally orthogonally to the second tab portion.

13. A web member as set forth in claim 1 wherein the tab at each end of the support section constitutes a first tab member and a second tab member, the first and second tab members being spaced apart a distance selected to receive the width of one of the beams therebetween, the first and second tab members each being adapted to receive a fastener for securing the tab member to the beam.

14. A web member as set forth in claim 11 in combination with other web members of the same construction, the first and second beams and the fasteners, the web members extending at angles between the beams and being secured to the beams by the fasteners passing through the tabs engaging the respective beam surfaces thereby forming a structural framework.

15. The combination as set forth in claim 14 wherein the fastener comprises:

a screw head;

a screw shank having a screw thread; and a transition section between the shank and the head, the transition section having a thickness greater than a thickness of the shank for increasing the strength of the transition section between the shank and the head of the screw.

16. A metal web member for use in a fabricated framework comprising at least two spaced apart beams with transverse thickness and having exterior surfaces and at least one web member secured to the beams and extending between exterior surfaces of the beams, said web member comprising:

a support section having transverse width substantially equal to or less than the transverse thickness of the beams and having opposite ends; and a tab extending longitudinally from the support section at each end thereof and having planar engagement surfaces, each tab being sized and shaped for generally flat, face-to-face engagement of its planar engagement surface with a respective one of the exterior surfaces of one of the beams for securement of the tab thereto, said tab being further adapted to receive a fastener through the planar engagement surface for the securement of the web member to the beams, the support section including a deformation adjacent the tab, the deformation having a pair of ridges defining a valley therebetween, each ridge angling laterally outwardly from a position adjacent the support section to a position adjacent the tab.

* * * * *